US008655256B2

(12) United States Patent
Furusawa et al.

(10) Patent No.: US 8,655,256 B2
(45) Date of Patent: Feb. 18, 2014

(54) RECORDING MATERIAL PROCESSING APPARATUS HAVING A BURR CURING DEVICE

(75) Inventors: Fumio Furusawa, Kanagawa (JP); Masataka Konishi, Kanagawa (JP); Yasushi Kawahata, Kanagawa (JP); Masakazu Takahashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 560 days.

(21) Appl. No.: 12/475,788

(22) Filed: Jun. 1, 2009

(65) Prior Publication Data

US 2010/0164166 A1 Jul. 1, 2010

(30) Foreign Application Priority Data

Dec. 25, 2008 (JP) ..... P2008-331489

(51) Int. Cl.
*B65H 29/70* (2006.01)
*B65H 5/36* (2006.01)

(52) U.S. Cl.
USPC ..... 399/390; 399/388

(58) Field of Classification Search
USPC ..... 399/388, 390, 406; 271/274, 273; 492/26
IPC ..... B65H 29/70,23/16; B41F 25/00
See application file for complete search history.

(56) References Cited

U.S. PATENT DOCUMENTS

| | | | | |
|---|---|---|---|---|
| 2006/0145414 | A1* | 7/2006 | Yokobori et al. | 271/258.01 |
| 2007/0206210 | A1* | 9/2007 | Miyazaki et al. | 358/1.14 |
| 2007/0284811 | A1* | 12/2007 | Nakazawa et al. | 271/242 |
| 2008/0063416 | A1* | 3/2008 | Watanabe | 399/45 |
| 2008/0247797 | A1 | 10/2008 | Yoshino et al. | 399/406 |

FOREIGN PATENT DOCUMENTS

| | | |
|---|---|---|
| JP | 10-218459 | 8/1998 |
| JP | 2005-179041 | 7/2005 |

* cited by examiner

*Primary Examiner* — Daniel J Colilla
*Assistant Examiner* — Ruben Parco, Jr.
(74) *Attorney, Agent, or Firm* — Morgan, Lewis & Bockius LLP

(57) ABSTRACT

A recording material processing apparatus includes a recording material supplying device supplying a recording material, an image recording device recording an image on the recording material, a recording material transporting mechanism and a burr curing device including a pressurizing member for curing the burrs at the edge of the recording material. The recording material transporting mechanism changes a transporting state of the recording material at a predetermined transportation changing position. The pressurizing member is provided on a recording material transporting path between the recording material supplying device and the transportation changing position and is provided on the side nearer to the recording material supplying device than a trailing end position. The trailing end position indicates a position of the trailing end of the recording material in the transporting path when a leading end of the recording material in the transporting direction passes the transportation changing position.

2 Claims, 23 Drawing Sheets

DRIVING MOTOR OPERATION (ONE SHEET TRANSPORTATION)

DRIVING MOTOR OPERATION
(PATTERN OF GENERATING SUPERPOSITION (1))

DOUBLE-SIDED RECORDING OPERATION

*LC : LOW CURRENT *HC : HIGH CURRENT

RECORDING MATERIAL PROCESSING APPARATUS HAVING A BURR CURING DEVICE

CROSS-REFERENCE TO RELATED APPLICATIONS

This application is based on and claims priority under 35 USC 119 from Japanese Patent Application No. 2008-331489 filed Dec. 25, 2008.

BACKGROUND

1. Technical Field

This invention relates to a recording material (or recording medium) processing apparatus.

2. Related Art

A recording material processing apparatus has been proposed in which a device for removing burrs at the edge of a recording material is arranged on the way of a recording material transporting path.

SUMMARY

According to an aspect of the invention, a recording material processing apparatus includes a recording material supplying device, an image recording device, a recording material transporting mechanism and a burr curing device. The recording material supplying device supplies a recording material. The image recording device records an image on the recording material at a predetermined recording position. The recording material transporting mechanism includes: a recording material transporting path that is between the recording material supplying device and the predetermined recording position of the image recording device; a transporting member that is arranged along the recording material transporting path. The recording material transporting mechanism changes a transporting state of the recording material at a predetermined transportation changing position of the recording material transporting path. The burr curing device includes: a pressurizing member which pressurizes the recording material to cure the burrs at the edge of the recording material. The pressurizing member is provided on the recording material transporting path between the recording material supplying device and the transportation changing position. The pressurizing member is provided on the side nearer to the recording material supplying device than a trailing end position. The trailing end position indicates a position of the trailing end of the recording material in the transporting path when a leading end of the recording material in the transporting direction passes the transportation changing position.

BRIEF DESCRIPTION OF THE DRAWINGS

Exemplary embodiment(s) of the present invention will be described in detail based on the following figures, wherein.

DETAILED DESCRIPTION

Summary of Exemplary Embodiments

First, an explanation will be given of the summary of exemplary embodiments of the recording material processing apparatus to which this invention is applied.

Figure 1:
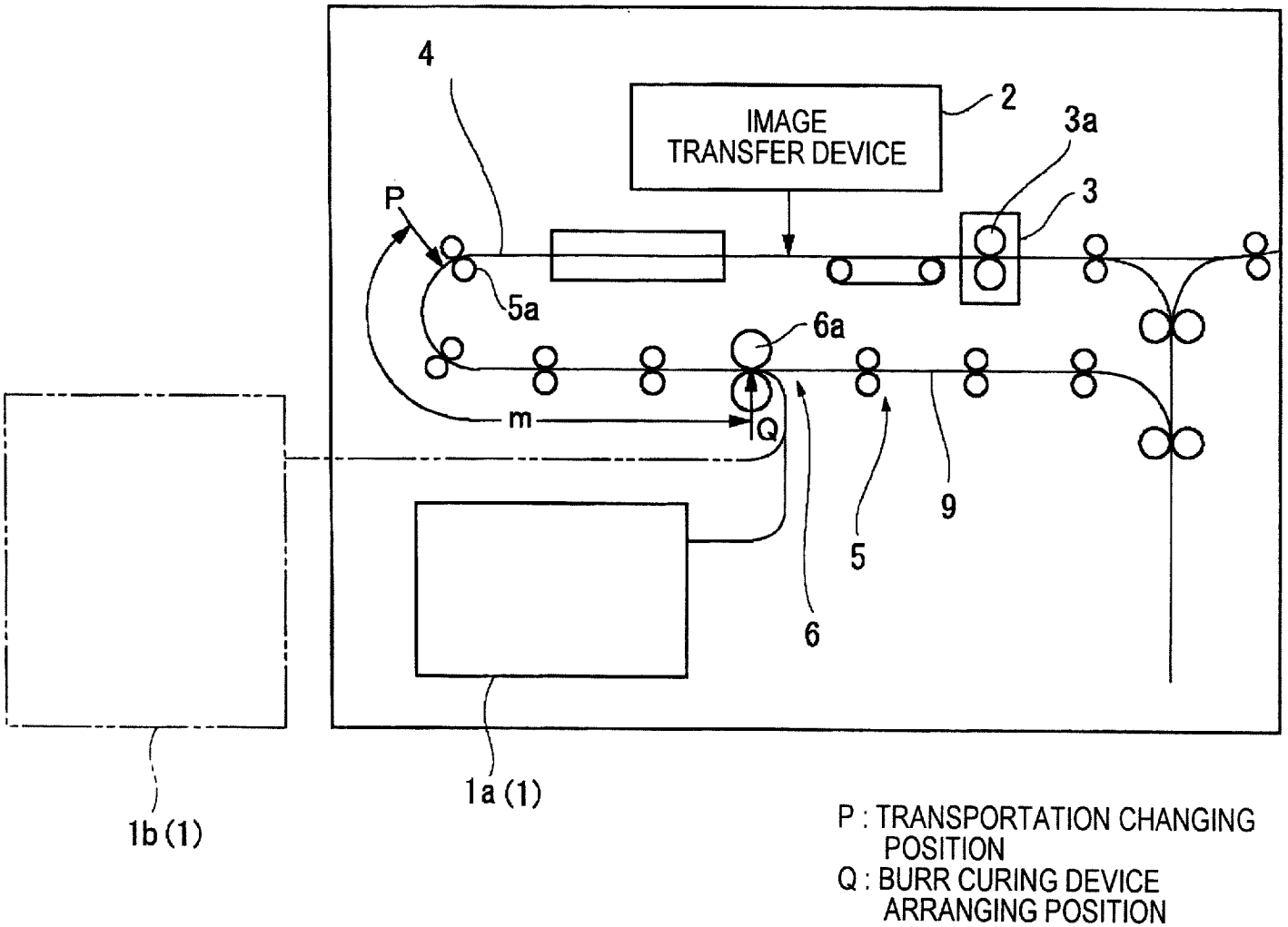
FIG. 1 is a view for explaining the outline of the exemplary embodiment of the recording processing.

In this exemplary embodiment, the recording material processing apparatus includes, as shown in FIG. 1, a recording material supplying device 1 (e.g. 1*a*, 1*b*) which supplies a recording material; an image transfer device 2 which transfers an image onto the recording material at a predetermined point; a fixing device 3 which fixes the image transferred on the recording material; a recording material transporting mechanism 5 which has a transporting members 5*a* arranged along a recording material transporting path 4 between the recording material supplying device 1 and the transferring point of the image transfer device 2 and changes the transporting state of the recording material at a predetermined transportation changing position P of the recording material transporting path 4; and a burr curing device 6 which has a pressurizing member 6*a* which pressurizes the recording material and cures the burrs at the edge of the recording material using the pressuring member 6*a*. The burr curing device 6 is provided on the side nearer to the recording material supplying device 1 than a trailing end position. The trailing end position indicates a position of the trailing end of the recording material in the transport path when the leading end in the transporting direction of the recording material passes the transportation changing position P.

The recording material processing apparatus exemplary refers to an image forming device incorporating an imaging device which forms an image to be transferred onto the recording material, but may include a recording material carry-in device provided outside the image forming device and a post-processing device.

Further, the recording material supplying device 1 includes not only an on-board type 1*a* incorporated in the image forming device, but also an out-board type 1*b* provided outside the box of the image forming device (for example, an out-board recording material carry-in device which (i) is provided outside the box of the image forming device incorporating the imaging device and (ii) carries the recording material in the box of the image forming device).

Further, the image transfer device 2 and fixing device 3 may be provided to carry out separately the transfer step and fixing step by separate bodies, and may be unified to carry out the transfer step and fixing step simultaneously or successively.

Further, the image transfer device 2 usually has a transfer member (e.g. an intermediate transfer body or a transfer roller), and the fixing device 3 usually has a fixing member 3*a* in contact with the recording material. According to the exemplary embodiment, damaging of the surface layer of the transfer member or fixing member 3*a* owing to the burrs at the edge of the recording material can be effectively avoided.

Further, the transportation changing position P of the recording material transporting mechanism 5 indicates the position where the transporting state of the recording material is changed. The transporting state includes a transporting speed or a transporting position.

Further, the number of the burr curing device 6 arranged is not necessarily single but may be plural. In the manner of providing plural recording supplying devices, the recording materials supplied from all the recording material supplying devices may pass the burr curing device 6. However, without being limited to such a manner, only the recording material supplied from a specific recording material supplying device 1 may pass the burr curing device 6.

Further, the burr curing device 6 may pressurize the recording material before the leading end of the recording material passes the transportation changing position P of the recording material transporting mechanism 5 thereby to cure the burrs at the edge of the recording material.

Now, the edge of the recording material which is subjected to burr curing includes the leading end in the transporting direction of the recording material, and may include the side edge in the transporting direction of the recording material and the trailing end in the transporting direction thereof.

Particularly, in this exemplary embodiment, the layout of the burr curing device 6 is important. In the recording material transporting path 4, the distance m between the transportation changing position P and the arranging position Q of the burr curing device 6 is required to be longer than the transported length of the recording material.

For this reason, when the leading end in the transporting direction of the recording material passes the transportation changing position P, the trailing end in the transporting direction of the recording material will pass the arranging position Q of the burr curing device 6. Thus, even if the transporting state of the recording material is changed, the recording material will not be affected by a predetermined pressurizing condition of the burr curing device 6.

Further, in the manner of providing plural recording material supplying devices 1, burr curing devices 6 may be individually arranged so as to correspond to the respective recording material supplying devices 1. However, from the standpoint of sharing the burr curing device 6, the layout of the burr curing device 6 may be to arrange the burr curing device 6 on the common recording material transporting path 4 along which the recording materials supplied from the plural recording material supplying devices are transported.

Further, in the manner of providing the plural recording material supplying devices 1, they may be provided in the manner incorporated in the image forming device box (on-board type 1*a*); may be provided in the manner of combining those incorporated in the forming device box and externally provided outside the image forming device box (on-board type 1*a* plus out-board type 1*b*); or may be provided in the manner externally provided outside the image forming device (out-board type 1*b*). Particularly, in the manner of adopting the out-board type 1*b* (externally provided recording material carry-in device) as the recording material supplying device 1, from the standpoint of permitting burr curing for also the recording material carried in the image forming device box from the out-board recording material carry-in device 1*b*, the burr curing device 6 may be arranged in the image forming device box or the out-board recording material carry-in device 1*b* so that the recording material supplied from the out-board recording material carry-in device 1*b* passes the burr curing device 6.

Further, the burr curing device 6 may be provided in the manner of subjecting the recording material passing to the burr curing at all times. However, from the standpoint of making the burr curing as the occasion demands, as shown in FIG. 2, the burr curing device 6 may be provided in the manner of contactably/retractably providing a pair of pressurizing members 6*a* through a contact/retract mechanism 6*b*.

In this manner, from the standpoint of avoiding the situation that unnecessary load is applied to the pair of pressurizing members 6*a*, the pair of pressurizing members 6*a* when the burr curing device 6 is not used, may be arranged to be retracted from each other.

Figure 2:
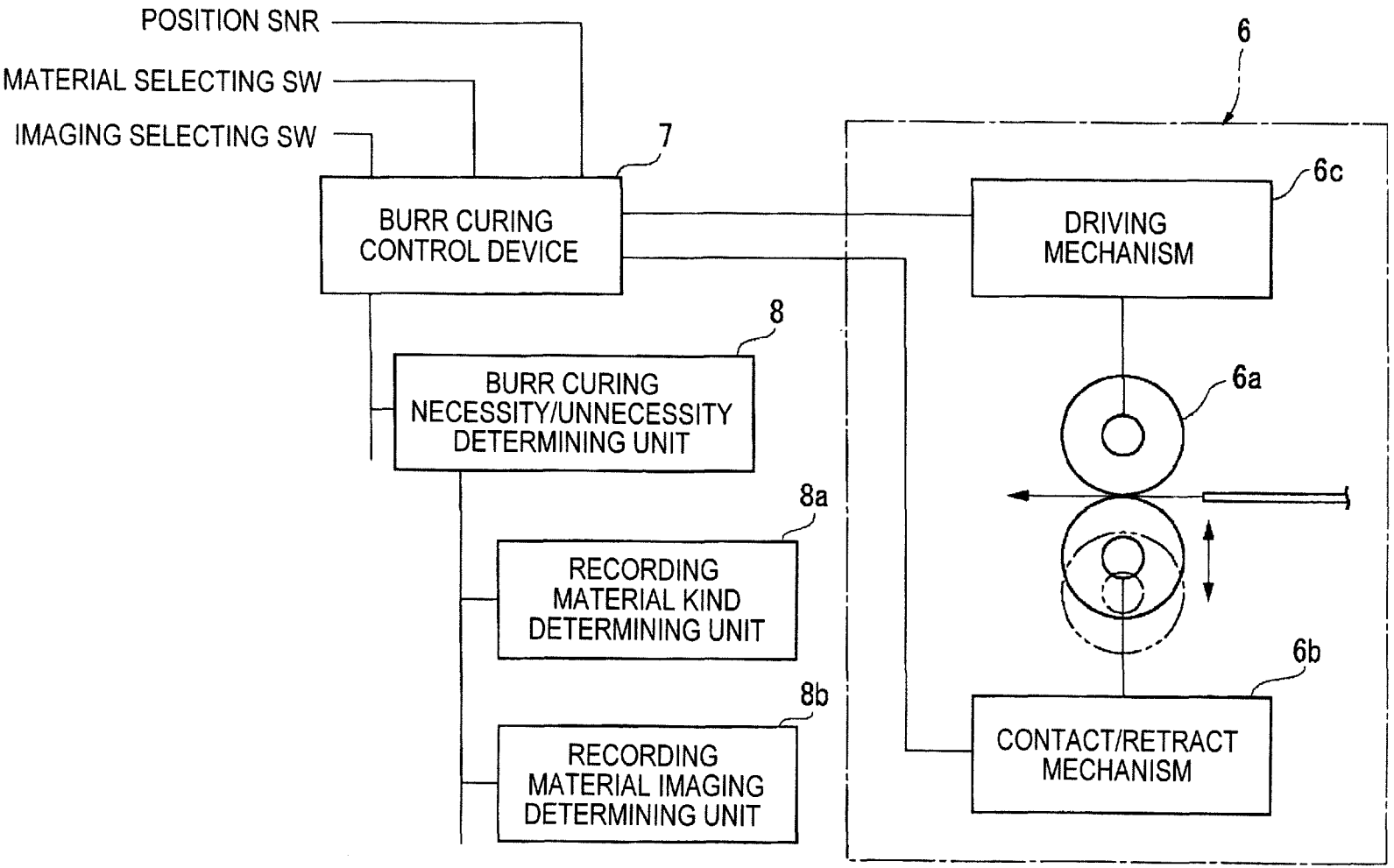
FIG. 2 is a view for explaining the outline of a burr curing device of the recording processing apparatus shown in FIG. 1 and its control system.

Further, in the manner that the pressurizing member 6*a* of the burr curing device 6 is a pressurizing/transporting member also serving as a transporting member of the recording material, from the standpoint of early making the stationary rotation of the pair of pressurizing/transporting members 6*a*, as shown in FIG. 2, when the burr curing device 6 is used, one of the pair of pressurizing/transporting members 6*a* being retracted from each other may be rotationally driven by a driving mechanism 6*c*, and thereafter they may be arranged to be in contact with each other by the contact/retract mechanism 6*b*.

Further, the speed of the burr curing device 6, in view of considering processing productivity of the recording material, may be set to transport the recording material higher than that of the recording material transporting mechanism 5 after the transportation changing position P of the recording material transporting mechanism 5.

Further, from the standpoint of effectively realizing the burr curing in the burr curing device 6, as shown in FIG. 2, a burr curing control device 7 may be provided which determines whether or not the burr curing of the recording material edge is necessary by a burr curing necessity/unnecessity determining unit 8 and causes the pair of pressurizing members 6*a* of the burr curing device 6 to come in contact or out-of-contact with each other based on the determining result.

As a exemplary manner of the burr curing control device 6, the burr curing control device 7 has a recording material kind determining unit 8*a* capable of determining the kind of the recording material (one manner of the burr curing necessity/unnecessity determining unit 8) and when the recording material kind determining unit 8*a* determines that the pertinent recording material is a recording material having a thickness larger than a predetermined thickness, the burr curing device 6 is controlled to cure the burrs at the edge of the pertinent recording material.

In this manner, if the thickness of the recording material is larger, the cut burr is also higher, which greatly influences the surface layer of the transfer member of the image transfer device 2 and the fixing member 3*a* of the fixing device 3 so that the burr curing is executed by the burr curing device 6. On the other hand, if the thickness of the recording material is smaller, the cut burr is also lower, which little influences the surface layer of the transfer member of the image transfer device 2 and the fixing member 3*a* of the fixing device 3 so that the burr curing may not be executed by the burr curing device 6.

Another exemplary manner of the burr curing control device 7 is as follows. For example, as shown in FIG. 1, a recording material returning path 9 is provided along which the recording material with the one-side already recorded via the image transfer device 2 and fixing device 3, after having being inverted, is returned toward the upstream side of the burr curing device 6. In addition, the burr curing control device 7, as shown in FIG. 2, has a recording material imaging determining unit 8*b* (one manner of the burr curing necessity/unnecessity determining unit 8) capable of determining whether the imaging on the recording material is performed during single-side recording or double-sided recording, and when the recording material imaging determining unit 8*b* determines that the imaging is performed during the double-sided recording, the burr curing device 6 is controlled to cure the burrs at the edge of the pertinent recording material.

This manner is based on the fact that if the recording material twice passes the burr curing device 6, the burrs at the edge of the recording material have been cured during the single-side recording so that in executing the double-sided recording of the recording material, the burr curing processing by the burr curing device 6 is not required.

Hereinafter, the invention will be explained in more detail on the basis of various exemplary embodiments shown in the attached drawings.

Exemplary Embodiment 1

—Entire Configuration of Recording Material Processing Apparatus—

Figure 3:
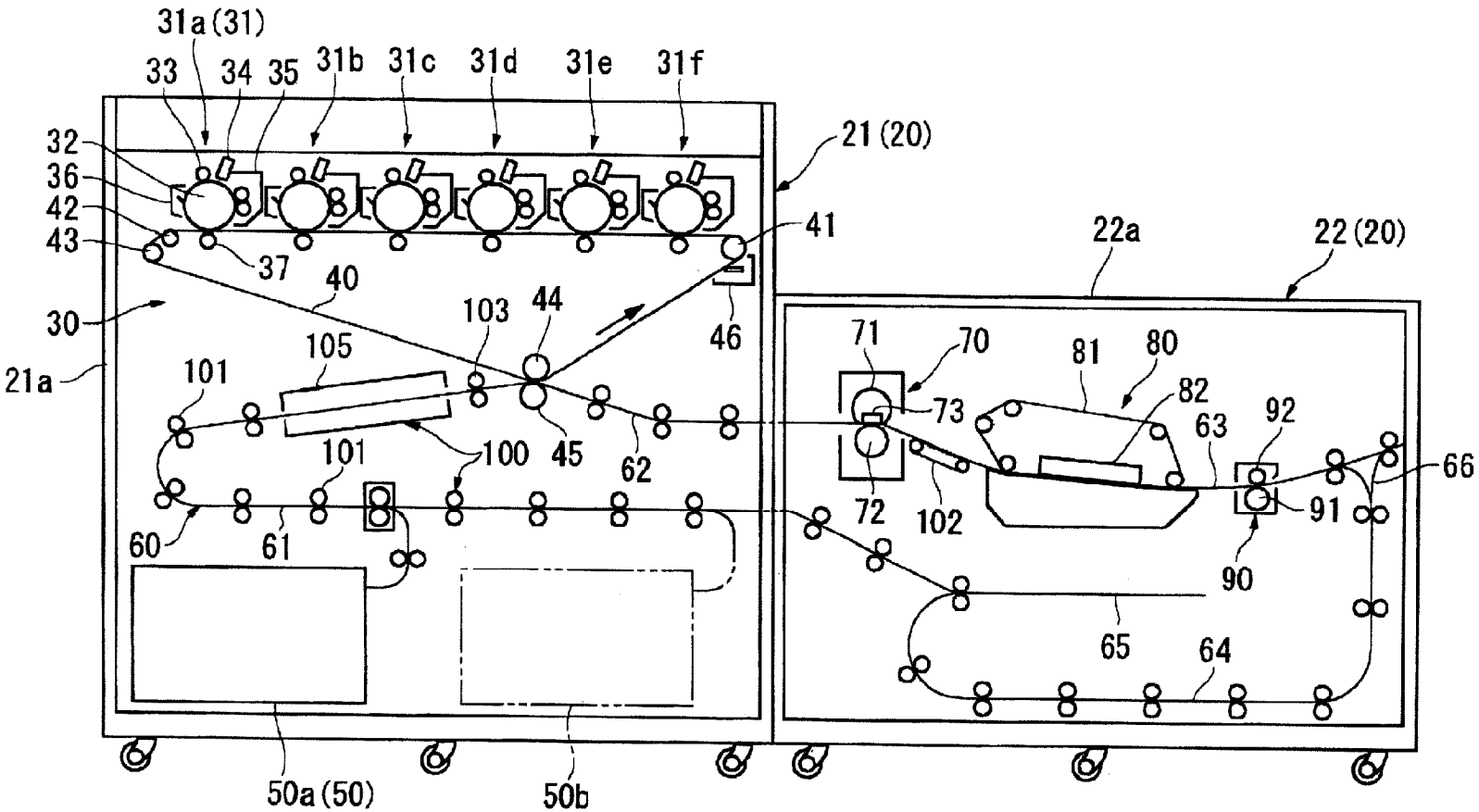
FIG. 3 is a view for explaining the entire configuration of a recording material processing apparatus according to the first exemplary embodiment.

FIG. 3 shows the entire configuration of a recording material processing apparatus according to the first exemplary embodiment.

As shown in FIG. 3, an image forming device 20 serving as the recording material processing apparatus includes an imaging unit 21 which subjects the recording material to imaging processing and a fixing unit 22 which subjects the recording material with the image formed to image fixing processing, which are separately arranged.

In this exemplary embodiment, the image forming device 20 serving as the recording material processing apparatus is separated into the imaging unit 21 and fixing unit 22, but without being limited to such a manner, the image forming device 20 may integrally include the imaging unit 21 and fixing unit 22. Further, the recording material processing apparatus is not only provided with only the image forming device, but also may be further provided with a post-processing device for subjecting the recording material with the image formed to post-processing or a recording material carry-in device for carrying the recording material in the image forming device box, separately from the image forming device 20.

<Imaging Unit>

In this exemplary embodiment, the imaging unit 21 incorporates an imaging device 30 for forming an image in an imaging unit box 21*a*; one or plural recording material supplying devices (e.g. 50*a*, 50*b*) are arranged below the imaging device 30; and a recording material transporting path 60 is provided between the recording material supplying device 50 and the imaging device 30.

Now, the imaging device 30 has a plurality of imaging engines 31 (e.g. 31*a* to 31*f*) in an electro-photographic system for forming the respective color components (e.g. yellow, magenta, cyan and black) or luster applying transparent images. In this imaging device 30, the respective color component images formed by the imaging engines are successively primary-transferred to an intermediate transfer belt 40 serving as an intermediate transfer body; thereafter, a multiple-transferred image held on the intermediate transfer belt 40 is secondary-transferred to the recording material.

In this exemplary embodiment, each of the imaging engines 31 (31*a* to 31*f*) includes a photosensitive drum 32 serving as a image holder, a charger 33 such as a charging roll for charging the photosensitive drum 32, a latent image writer 34 such as an LED for writing an electrostatic latent image onto the photosensitive drum 32 charged by the charger 33, a developer (developing member) 35 for visualizing the electrostatic latent image on the photosensitive drum 32 written by the latent image writer 34 using the developing agent having each color component toner, and a cleaner 36 for cleaning the toner left on the photosensitive drum 32 in the toner image visualized by the developer 35. A known device may be widely adopted as each electro-photographic device;

for example, as the latent image writers 34, laser scanning devices may be employed wholly or partially commonly in place of the respective LED arrays.

Opposite to the photosensitive drum 32 of each imaging engine 31 (31*a* to 31*f*) through the intermediate transfer belt 40, a primary transfer member 37 such as a primary transfer roll is arranged. By forming a prescribed transfer electric field between the primary transfer member 37 and the photosensitive drum 32, each color component toner image formed on the photosensitive drum 32 will be transferred to the intermediate transfer belt 40.

Further, in this exemplary embodiment, the intermediate transfer belt 40 is stretched across stretching rolls 41 to 44 serving as plural stretching members. For example, using the stretching roll 41 as a driving roll and the stretching roll 43 as a tension roll for giving tension, the intermediate transfer belt 40 is circulation-rotated.

Further, at a point opposite to the stretching roll 44 through the intermediate transfer belt 40, a secondary transfer member 45 such as a secondary transfer roll is arranged. This secondary transfer member 45 serves to nip and transport the recording material between itself and the intermediate transfer belt 40 and also forms a secondary transfer electric field with the stretching roll 44 being an opposite electrode, thereby transferring each color component toner image on the recording material.

Additionally, at a point opposite to e.g. the stretching roll 41 through the transfer belt 40 in the downstream side of the secondary transfer region of the intermediate transfer belt 40, an intermediate cleaner 46 is provided to clean the toner left on the intermediate transfer belt 40.

In this exemplary embodiment, the recording material supplying device 50 (e.g. 50*a*) has a feeder 51 (see FIG. 4) which is a sheet feeding mechanism which feeds the recording materials one by one. The recording material will be fed by this feeder 51 at a predetermined transporting speed $v_0$ (high speed: e.g. 1000 mm/sec.).

Further, the recording material transporting path 60 within the imaging unit 21 includes a pre-imaging transporting path 61 which guides the recording material supplied from each recording material supplying device 50 (50*a*, 50*b*) to the second transfer point of the imaging device 30 and a post-imaging transporting path 62 which guides the recording material having passed the secondary transfer point toward the fixing unit 22 side.

On the recording material transporting path 60, a recording material transporting mechanism 100 for transporting the recording material is provided and a burr curing device 120 for curing the burr at the edge of the recording material is also provided.

The recording material transporting mechanism 100 and burr curing device 120 will be explained later in detail.

<Fixing Unit>

In this exemplary embodiment, the fixing unit 22 has, within a fixing unit box 22*a*, a post-imaging transporting path 63 connected to the post-imaging transporting path 62 within the imaging unit 21. On the post-imaging transporting path 63, a fixing device 70 which fixes the image formed by the imaging unit 21 onto the recording material is arranged; on the downstream side in the recoding material transporting direction of the fixing device 70, a cooling device 80 for cooling the recording material is arranged; and on the downstream side of the cooling device 80, a curl curing device 90 for curing the curl of the recording material is arranged.

Now, the fixing device 70 includes a pressurizing roll 71 serving as a fixing member, a pressurizing roll 72 serving as an opposite member opposite to the fixing belt 71, and a pressing pad 73 for pressing the fixing belt 71 onto the pressurizing roll 72. By heating the fixing belt 71, the recording material will be nipped and transported between the fixing belt 71 and the pressurizing roll 72 and the non-fixed toner image on the recording material will be heating/pressurizing-fixed.

In this exemplary embodiment, in view of heat-resistance or exfoliation capability, the fixing belt 71 has a releasing layer of e.g. PFA formed on a belt base surface.

Further, the cooling device 80 has for example, a transporting belt 81 which transports the recording material after-fixed; behind the transporting belt 81, a heat sink 82 serving as a cooling member is arranged thereby to cool the recording material being transported by the transporting belt 81.

Further, the curl curing device 90 ensures a nipping shape capable of curing the curl of the recording material between a pair of curing rolls 91 and 92, thereby curing the curl of the recording material in the process of nip-transporting the recording material.

Further, on the downstream side in the recording material transporting direction of the curl curing point in the post-imaging transporting path 63, a return-transporting path 64 is provided for returning the recording material with the single-side recorded to the imaging unit 21 side; on the way of the return transporting path 64, an inverting transporting path 65 is provided for turning upside down the recording material.

In this exemplary embodiment a branching point between the post-imaging transporting path 63 and the return transporting path 64, an inverting discharging path 66 is also provided so that for example, the recording material with the single-side recorded can be once pulled in the return transporting path 64 and thereafter discharged via the inverting discharging path 66.

—Recording Material Transporting Mechanism—

Figure 4:
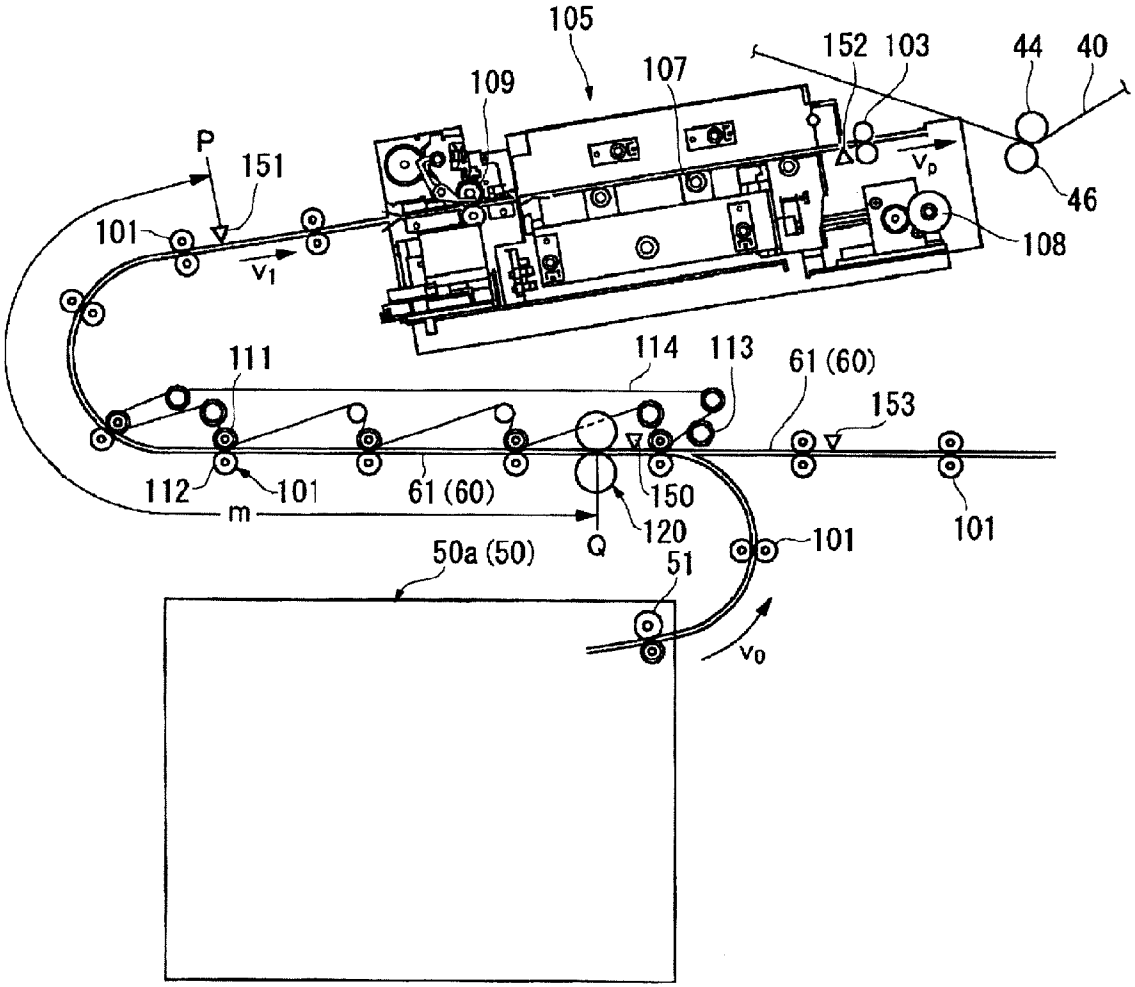
FIG. 4 is a view for explaining the main part including a burr curing device of the recording material processing apparatus according to the first exemplary embodiment.
Figure 5:
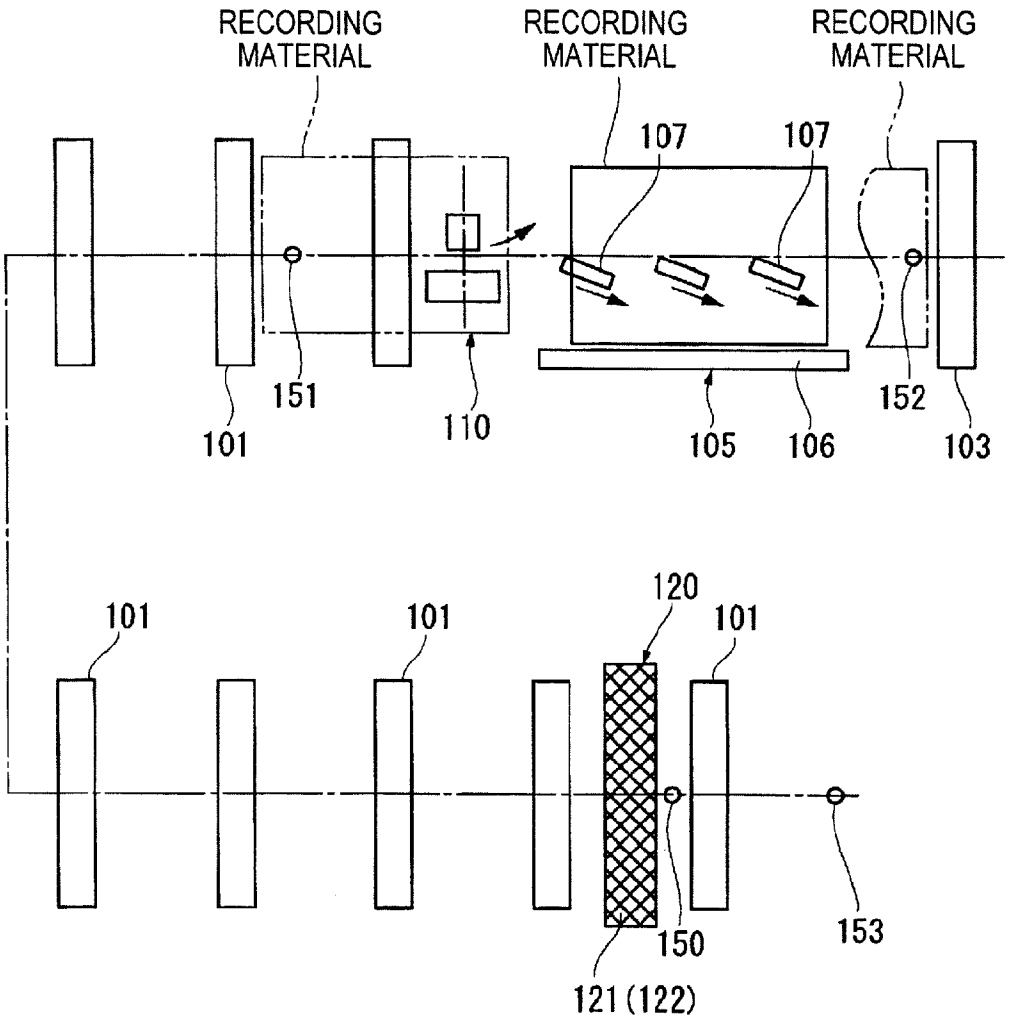
FIG. 5 is a plan view of the burr curing device and transporting members in a recording material transporting path shown in FIG. 4.
Figure 6A:
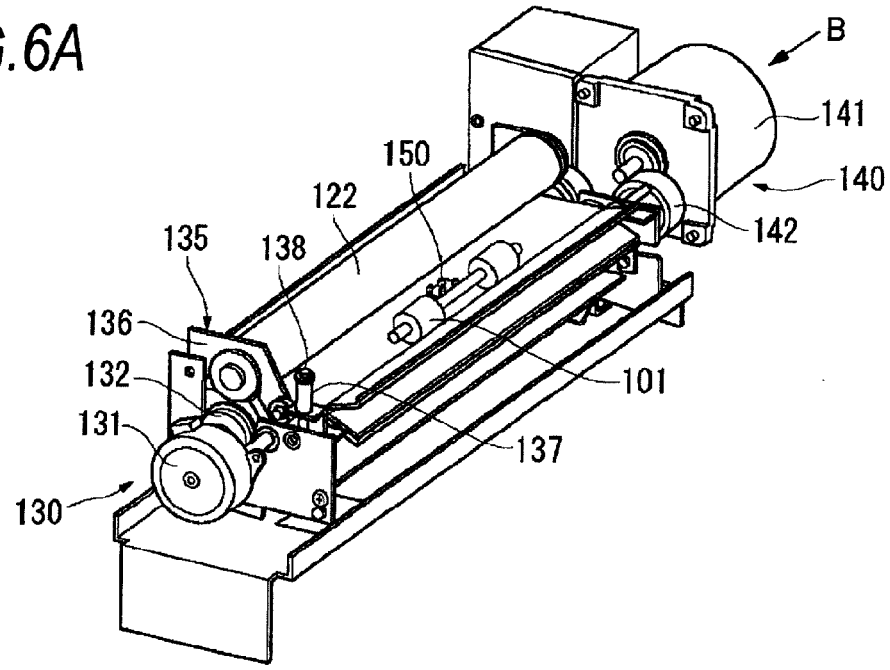
FIG. 6A is a perspective view of the burr curing device employed in the first exemplary embodiment.
Figure 6B:
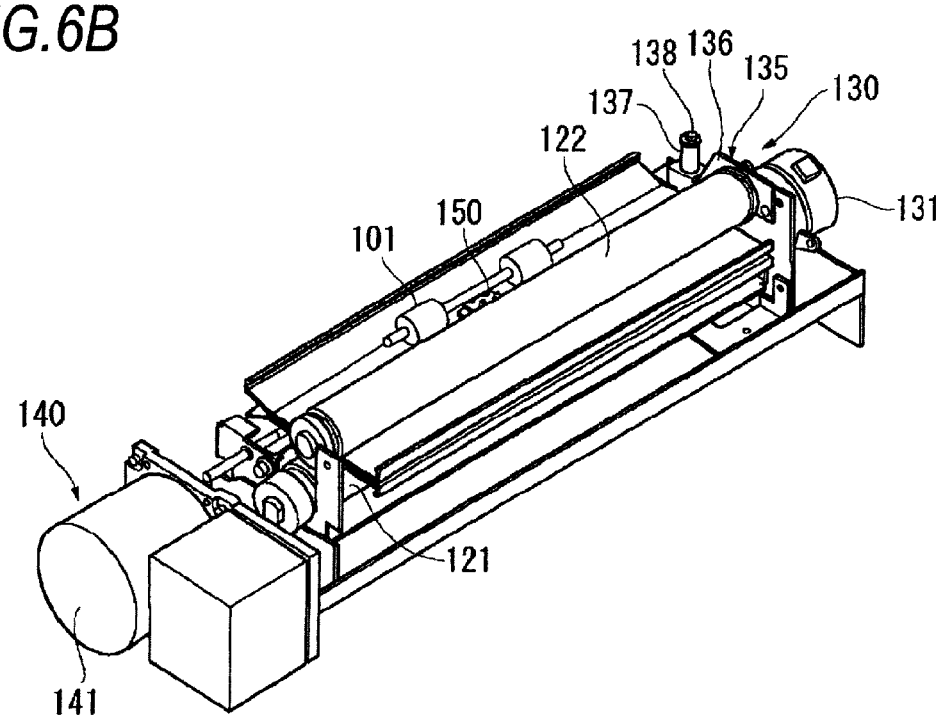
FIG. 6B is a perspective view seen in an arrow B direction in FIG. 6A.

In this exemplary embodiment, the recording material transporting mechanism 100, as shown in FIGS. 3 to 5, includes transporting rolls 101 transporting belt 102 serving as a plurality of transporting members appropriately arranged on the recording material transporting path 60 (inclusive of the pre-imaging transporting path 61, post-imaging transporting paths 62, 63, return transporting path 64 and inverting transporting path 65); an aligning roll (resist roll) 103 arranged before the secondary transfer point of the imaging device 30 in the pre-imaging transporting path 61 and serving as an aligning member for aligning the leading end position of the recording material transported regarding the timing of being carried into the secondary transfer position; and a side aligning mechanism 105 arranged before the resist roll 103 and aligning the one side edge position (side position) in a width direction crossing the transporting direction of the recording material transported.

Now, the side position aligning mechanism 105, for example, as shown in FIGS. 4 and 5, includes an aligning plate 106 for specifying the one side edge in the width direction of the recording material and a plurality of aslant-transporting rolls 107 for executing aslant-transporting the recording material toward the aligning plate 106. The aslant-transporting roll 107 serves to nip and transport the recording material at a predetermined transporting speed v1 (low speed: $v_1<v_o$: e.g. 600 mm/sec) with a driving motor 108.

Further, the side position aligning mechanism 105 has a guide-transporting roll 109 at its inlet, the guide-transporting roll 109 carries the recording material with limiting the carry-in direction of the recording material to the side separated from the aligning plate 106.

Further, each the transporting rolls 101 arranged on the recording material transporting path 60 has a drive-transporting roll 111 and a driven-transporting roll 112 in pressure-contact therewith. The system for driving the transporting rolls 101 is provided in the manner that a driving belt 114 driven by e.g. a driving motor 113 is stretched over the drive-transporting rolls 111 of the plurality of transporting rolls 101 and each drive-transporting roll 111 is driven at a predetermined transporting speed.

The resist roll 103 is driven by a driving motor 110 (see FIG. 9) and nips and transports the recording material at a transporting speed $v_p$ corresponding to the process speed by the imaging processing of the imaging device 30 (process speed: $v_p<v_1$: e.g. 400 mm/sec.).

—Position Detector—

Further, on the recording material transporting path 60, position detectors (position sensors) are appropriately arranged to detect the passing positions of the recording material transported in the recording material transporting path 60.

Now, the position detector may be appropriately selected from an optical type, a mechanical type (actuator type), etc.

Referring to FIGS. 4 and 5, typical position detectors will be described below.

At the position immediately after passing the transporting roll 101 adjacent on the upstream side of the burr curing device 120, a position detector 150 is arranged which indicates that the leading end of the recording material has reached the inlet of the burr curing device 120.

Further, in the pre-imaging transporting path 61, at the position P separated from the arranging position Q of the burr curing device 120 by the distance m longer than the length (e.g. 19.2 inch: 488 mm) in the transporting direction of the recording material having a maximum size, a transportation changing position detector 151 is arranged for changing the transporting speed of the recording material.

Further, in the pre-imaging transporting path 61, at the position immediately before the arranging position of the resist roll 103, a resist position detector 152 is arranged.

Further, in the case where the imaging mode is a double-sided recording mode, in the pre-imaging transporting path 61, at the position on a more upstream side in the recording material transporting direction than the burr curing device 120 and where the recording material with the single side recorded passes, a double-sided recording position detector 153 is arranged for determining the recording material whose second face is an imaging plane at the time of the double-sided recording mode.

—Burr Curing Device—

Generally, if the recording material cut for each predetermined size is thick, burrs will be mostly formed at the edge of the recording material owing to cutting.

With the burrs of the recording material being left as they are, where the recording material is employed in the recording material processing device, if the height of the cut burrs of the recording material is larger, there is fear that the burrs of the recording material damages the intermediate transfer belt 40, the secondary transfer (e.g. secondary transfer roll) 45 or the surface releasing layer of the fixing belt 71 of the fixing device 70.

Therefore, in this exemplary embodiment, in order to cure the burrs formed at the edge of the recording material, as shown in FIGS. 3 to 5, a burr curing device 120 is arranged on the pre-imaging transporting path 61 in the recording material transporting path 60.

In this exemplary embodiment, the burr curing device 120, as shown in FIG. 4 to 8, has a pair of pressurizing/transporting rolls 121, 122 which rotate in pressure-contact with each other; for example the one pressurizing/transporting roll 121 is used as a driving roll and the other pressurizing/transporting roll 122 is used as a driven roll.

Now, as these pressurizing/transporting rolls 121, 122, roll bodies made of a hard material are employed. Namely, the pressurizing/transporting roll 121, 122 may be a roll body 123 in a hollow-cylindrical shape by e.g. steel of S45C; the surface of the roll body 123 is subjected to high frequency quenching processing and hardening processing (nitriding processing or increasing the surface hardness to Hv1000 or so using a TaC coating layer).

Further, in this exemplary embodiment, the one pressurizing/transporting roll 121 serving as the driving roll is provided with a driven gear 125 of resin such as 46 nylon (trade mark) at the one of both axial ends 124 of the roll body 123.

On the other hand, the other pressurizing/transporting roll 122 serving as the driven roll has ring-shaped elastic spacers 126 of PI at both ends of the roll body 123. By intervening of the elastic spaces 126, a minute gap g (e.g. 0.1 mm) is ensured between itself and the one pressurizing/transporting roll 121.

The elastic spacer 126 serves to restrain generation of unusual sound, prevent wrinkles from being generated when a thin recording material passes and further restrict torque-up when the recording material is nipped.

Further, the burr curing device 120 also includes a contact/retract mechanism 130 which permits the pair of pressurizing/transporting rolls 121, 122 to be contactable/retractable.

The contact/retract mechanism 130 includes a retract motor 131 and a cam member 132 causing the one pressurizing/transporting roll 121 being the driving roll to come in contact or out-of-contact with the other pressurizing/transporting roll 122 being the driven roll in association with the rotation of the retract motor 131.

Now, although the rotating direction of the retract motor 131 may be appropriately selected, a technique of rotating it in one direction (e.g. counterclockwise direction) is adopted. Further, a position detector (retract sensor) not shown is provided for detecting the rotating position of the retract motor 131.

In this exemplary embodiment, the contact/retract mechanism 130 has a pressurizing mechanism 135 for pressurizing the one pressurizing/transporting roll 122 toward the other pressurizing/transporting roll 121. The pressurizing mechanism 135 is provided with a swingable pressurizing lever 136 at the one axial end of the one pressurizing/transporting roll 122. By urging the pressurizing lever 136 using a pressurizing spring 137, when the one pressurizing/transporting roll 121 is located at the contact position, the one pressurizing/transporting roll 121 is pressurized toward the other pressuring-transporting roll 122 at a prescribed load (e.g. 50 kgf to 60 kgf: 480N to 580N).

Now, the urging force of the pressurizing spring 137 of the pressurizing mechanism 135 can be made adjustable, for example by appropriately moving an adjusting screw 138.

Further, the burr curing device 120 is provided with a driving mechanism 140 for driving the one pressurizing/transporting roll 121.

The driving mechanism 140 includes a driving motor 141 such as a DC motor and a drive transmission mechanism 142 such as a chain of drive transmission gears for transmitting the rotary driving force from the driving motor 141 to the pressurizing/transporting roll 121 in association with the rotation of the driving motor 141. The most downstream transmission gear of the drive transmission mechanism 142 is tooth-engaged with a driven gear 125 of the pressurizing/transporting roll 121.

In this exemplary embodiment, the driving mechanism 140 nip-transports the recording material in the pressurized state using the pair of pressurizing/transporting rolls 121, 122. In this case, the transporting speed is set at a constant speed equal to the transporting speed $v_0$ (e.g. 1000 mm/sec.) when the recording material is fed from the feeder 51 of the recording material supplying device 50.

Further, in the pre-imaging transporting path 61, on the upstream side and downstream side in the recording material transporting direction of the burr curing device 120, transporting rolls 101 are arranged. In this case, the distance L between the arranging position Q of the burr curing device 120 (position on the line connecting the center axes of the pressurizing/transporting rolls 121, 122) and the transporting roll 101 adjacent thereto is set to be shorter than the distance in the transporting direction of at least the recording material with a minimum size (e.g. postal card size).

Figure 7:
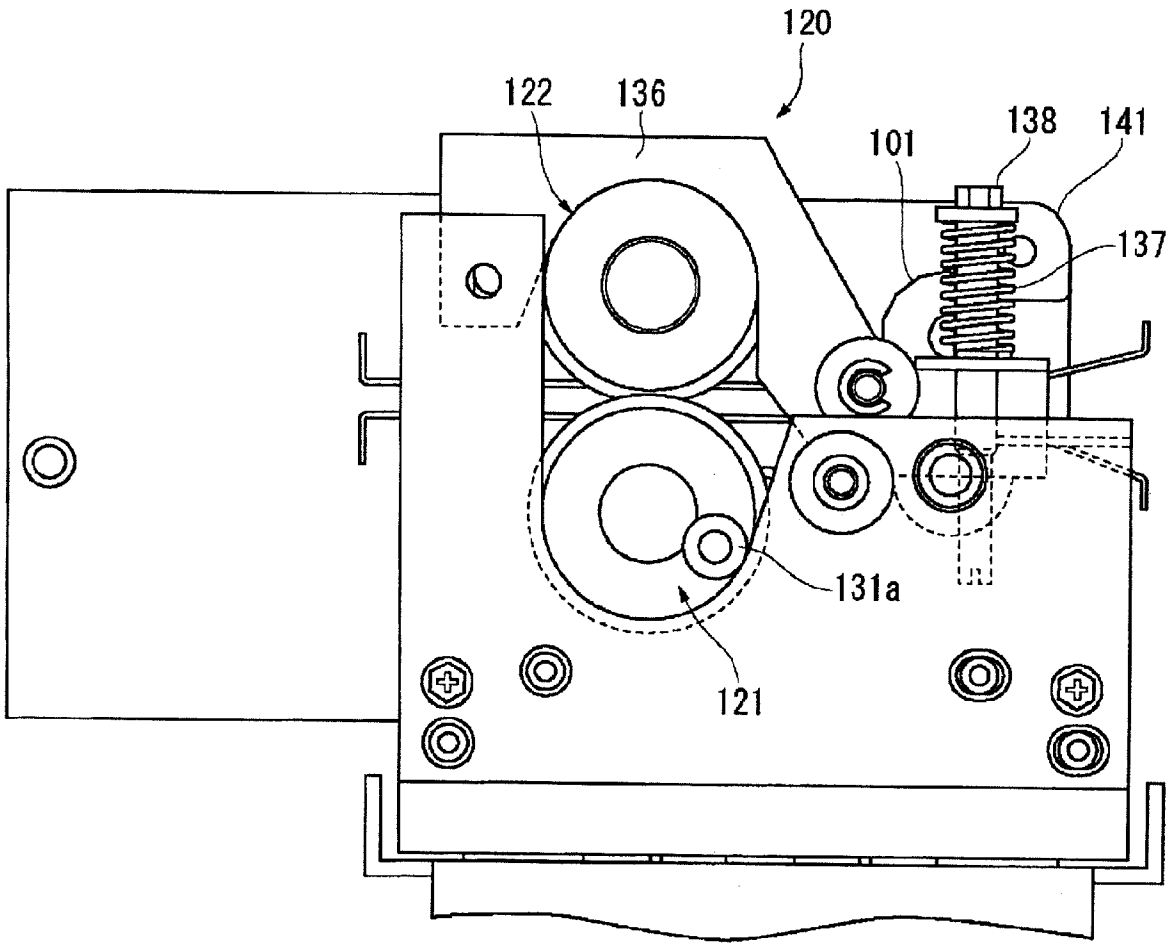
FIG. 7 is a front view of the burr curing device employed in the first exemplary embodiment.
Figure 8A:
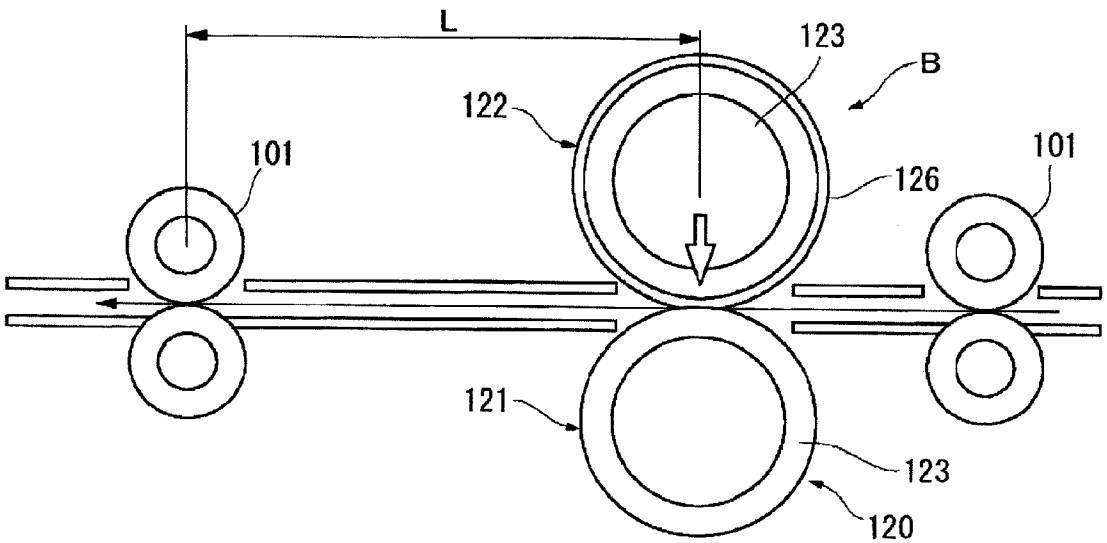
FIG. 8A is a view for explaining a pressurizing/transporting roll being a constituent element of the burr curing device.
Figure 8B:
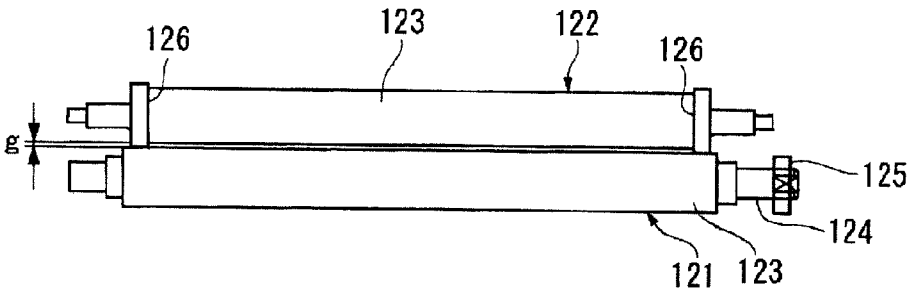
FIG. 8B is a perspective view seen in an arrow B direction in FIG. 8A.

In FIG. 7, reference symbol 131*a* denotes the motor shaft of the retract motor 131.

—Control System—

Figure 9:
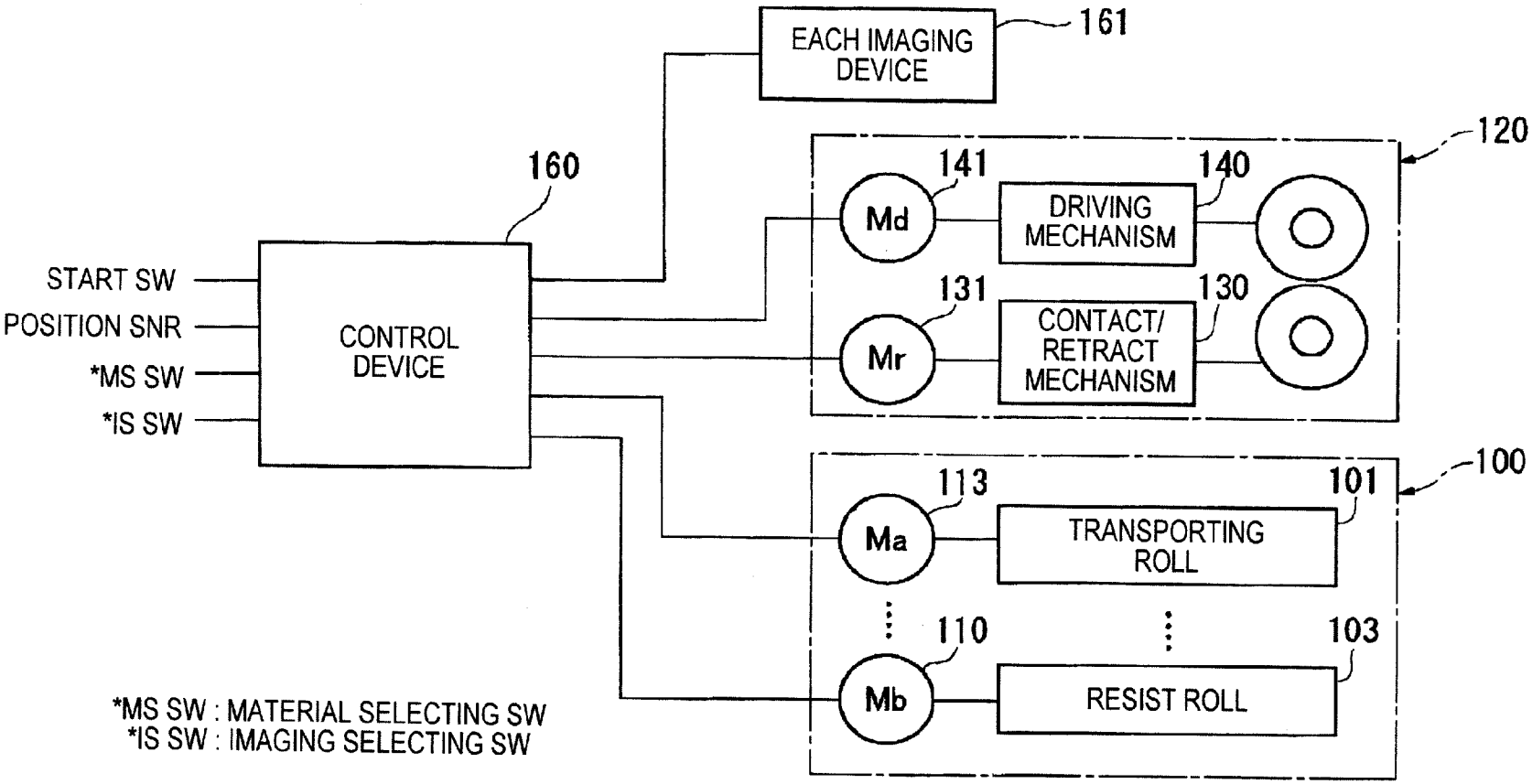
FIG. 9 is a view for explaining the control system of the recording material processing apparatus employed in the first exemplary embodiment.

In this exemplary embodiment, the control system of the recording material processing apparatus, for example, as shown in FIG. 9, includes a control device 160 of e.g. a microcomputer. The control device 160 is supplied with respective signals from a start switch (start SW) for starting the processing operation by the recording material processing apparatus, position detectors (position SNR) 150, 151, 152, . . . located on the recording material transporting path, a recording material selecting switch (recording material selecting SW) for selecting the kind of the recording material and an imaging mode switch (imaging mode SW) for selecting the imaging mode of the imaging device 30 thereby executing the programs (an imaging program, a recording material transportation control program, etc.) previously stored in the control device 160. Thus, the control device 160 sends various control signals to imaging devices 161, retract motor (Mr) 131 of the contact/retract mechanism 130 of the burr curing device 120, driving motor (Md) 141 of the driving mechanism 140, driving motor (Ma) 113 of the transporting rolls 101 of the recording material transporting mechanism 100, driving motor (Mb) 110 of the resist roll 103, etc.

—Operation of the Recording Material Processing Apparatus—

<Recording Material Transportation Control>

Next, an explanation will be given of the operation of the recording material processing apparatus according to this exemplary embodiment.

Figure 10:
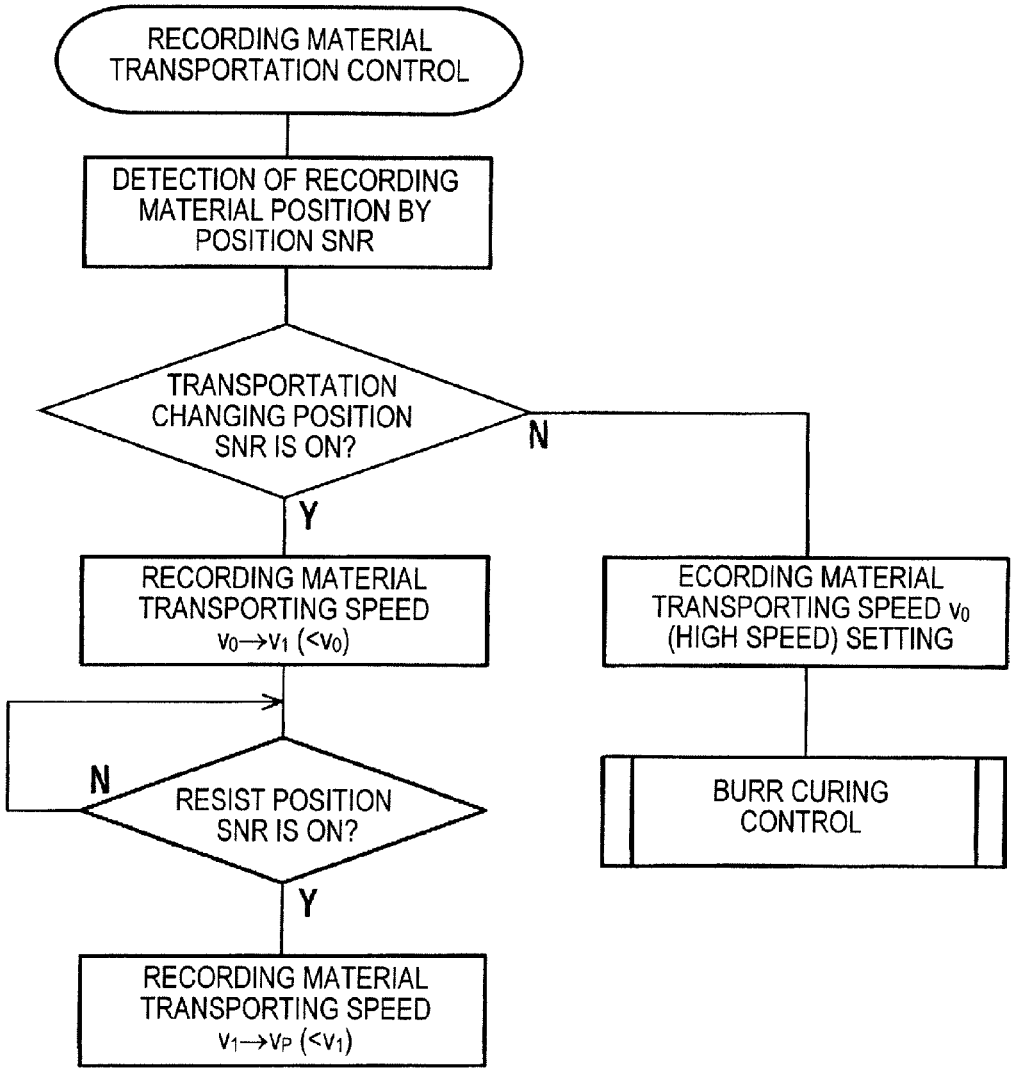
FIG. 10 is a flowchart of the recording material transportation control process employed in the first exemplary embodiment.

The control device 160 shown in FIG. 9 executes the transportation control of the recording material according to the flowchart shown in FIG. 10.

In FIG. 10, when the start switch is turned on, the control device 160 starts the imaging processing and starts the supply of the recording material from the predetermined recording material supplying device 50 (e.g. 50*a*).

At this time, the recording material supplying device 50 (50*a*) transports the recording material at a transporting speed $v_0$ (high speed).

The control device 160 causes the position detector (position SNR) to detect the position of the recording material. If the transportation changing position detector 151 is off, the control device 160 causes the recording material transporting mechanism 100 to transport the recording material at the transporting speed $v_0$ (high speed) and executes the burr curing control (see FIG. 11) when the recording material passes the burr curing device 120. After the leading end of the recording material passes the transportation changing position detector 151, the transportation changing position detector 151 turns on. At this timing, the control device 160 causes the recording material transporting mechanism 100 to transport the recording material at a transporting speed $v_1$ (low speed).

In this situation, although the transporting speed of the recording material is changed from the high speed $v_0$ to the low speed $v_1$, even if the recording material having a maximum size is employed, as shown in FIG. 4, when the leading end in the transporting direction of the recording material passes the transportation changing position P, the trailing end in the transporting direction of the pertinent recording material has already passed through the burr curing device 120. For this reason, it is not necessary to change the transporting speed of the recording material by the burr curing device 120 and so possible to keep it constant.

Here, obtaining a high nipping load between the pressurizing/transporting rolls 121, 122 causes the pressurizing/transporting rolls 121, 122 to be large in size and thickness, that is, obtaining the high nipping load gives large inertia.

Therefore, they are not suitably located at a speed changing position. However, in this exemplary embodiment, it is not necessary to accelerate/decelerate the pressurizing/transporting rolls 121, 122 pressurized at a high pressure, and also not necessary to control the contact/retract of the these pressurizing rolls. As a result, there is no fear that the driving control and contact/retract control of the burr curing device 120 are made complicate.

The details of the burr curing control will be described later.

The recording material decelerated, as shown in FIGS. 3 to 5, is guided into a side position aligning mechanism 105 in an aslant direction separated from the aligning plate 106 of the side position aligning mechanism 105 by a guide-transporting roll 110 and thereafter aslant-transported by the aslant-transporting rolls 107 of the side position aligning mechanism 105. Then, the one edge in the width direction of the recording material is hit against the aligning plate 106 so that the side position of the recording material is aligned by the aligning plate 106.

Further, after the leading end of the recording material with its side position aligned passes the resist position detector 152, the speed of the recording material is adjusted by the resist roll 103 to a process speed $v_p$. Thereafter, the recording material is guided to the secondary-transfer point of the imaging device 30.

At this step, the imaging device 30 transfers the respective color component toner images made by the respective imaging engines 31 (31*a* to 31*f*) to the recording material through the intermediate transfer belt 40 and secondary transfer member 45.

The recording material subjected to the transfer reaches the fixing device 70 of the fixing unit 22 at the process speed $v_p$ maintained. Thus, the toner images on the recording material are fixed on the recoding material through the fixing processing by the fixing device 70. Thereafter, if the imaging mode is the single-sided recording mode, the recording material after the fixing, is accommodated into a recording material tray (not shown) via the cooling device 80 and curl curing device 90.

On the other hand, if the imaging mode is the double-sided recording mode, the recording material after the fixing, after having passed the cooling device 80 and curl curing device 90, is transported onto the return-transporting path 64 and further, on the way, turned upside down by the inverting-transporting path 65. Eventually, the recording material is transported to the pre-imaging transporting path 61 again. Then, the other side of the recording material with the one side recorded is subjected to a series of imaging processing operations. Upon completion of the imaging processing, the recording material with both sides recorded is discharged and accommodated into the recording material tray (not shown) via the fixing device 70, cooling device 80 and curl curing device 90.

From the standpoint of productivity of the recording material, in the case of the double-sided recording, when the recording material with the one side recorded is returned to the pre-imaging transporting path 61 via the return-transporting path 64 and inverting-transporting path 65, its speed may be changed from the process speed $v_p$ into the transporting speed $v_0$ of the high speed.

—Burr Curing Control—

Figure 11:
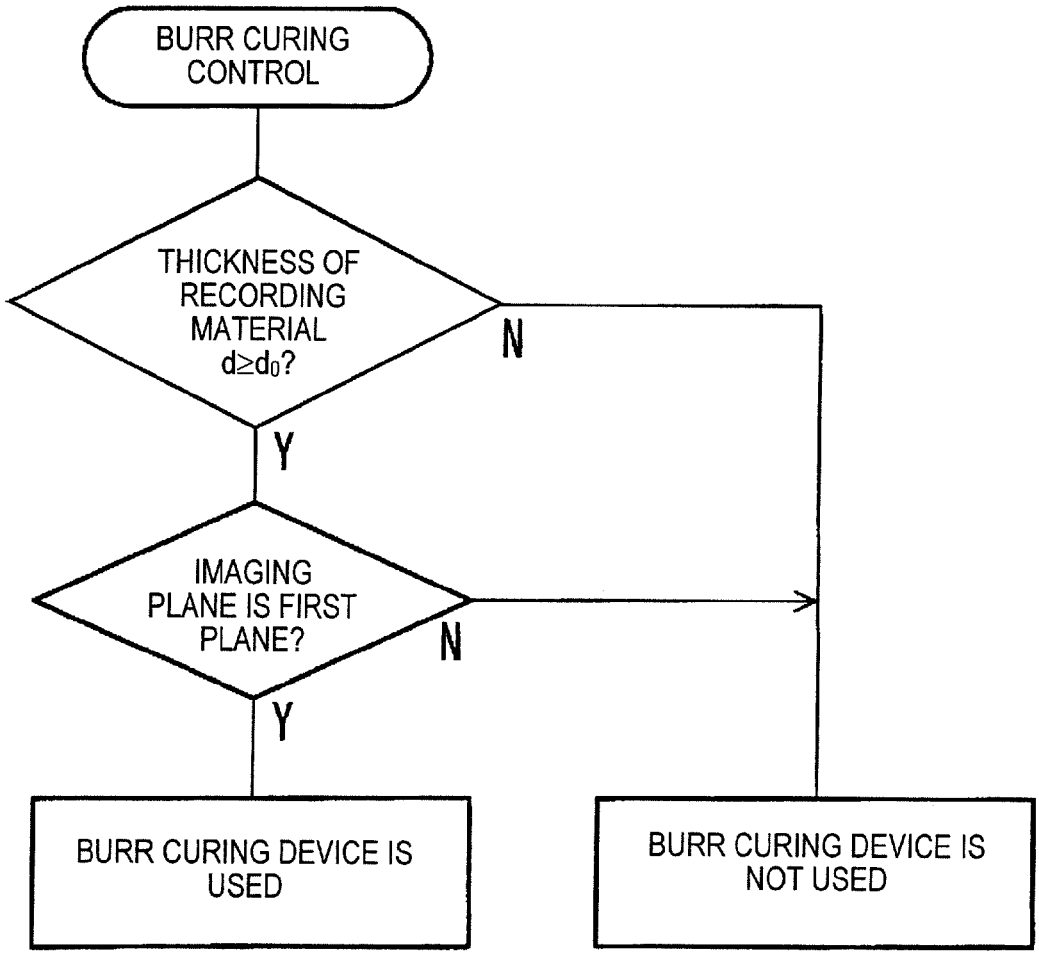
FIG. 11 is a flowchart of a sub-routine of the burr curing control in FIG. 10.

On the basis of the information supplied from e.g. the recording material selecting switch, the control device 160, as shown in FIG. 11, determines whether or not the thickness d of the recording material is equal to a prescribed reference thickness $d_0$ (e.g. 100 μm) or more. Further, on the basis of the imaging mode switch and position recognition, the control device 160 determines whether the imaging plane is a first plane or a second plane. Under the condition that the thickness of the recording material $d \geq d_0$, and the imaging plane is the first plane, the control device 160 uses the burr curing device 120. Under the condition other than the above condition, the control device 160 sets the burr curing device 120 in its non-used state.

The reason why the reference thickness $d_0$ of the recording material is selected is to avoid the risk that a thin recording material is weak and apt to generate wrinkles. Particularly, in the case of the thin recording material, it is based on the fact that if height of the burrs to be cut is relatively low and the recoding material is thin, since the deforming quantity itself of the releasing layer of the fixing belt 71 of the fixing device 70 is small, the damage to the releasing layer is slight.

The reason why if the imaging plane is the second plane, the burr curing device 120 is set in the non-used state is based on the fact that since the burr curing processing by the burr curing device 120 has been done in the case of the imaging plane being the first plane, the necessity of newly executing the burr curing processing is slight.

In this exemplary embodiment, the use/non-use of the burr curing device 120 is controlled by the thickness of the recording material and imaging plane. However, without being limited to them, the use/non-use of the burr curing device 120 may be controlled by either one of them. Otherwise, the burr curing device 120 may be always used or may be made selectively usable by the user's will.

—Example of Operation of the Burr Curing Device—

<Driving Motor Operation: One Sheet Transportation>

Figure 12:
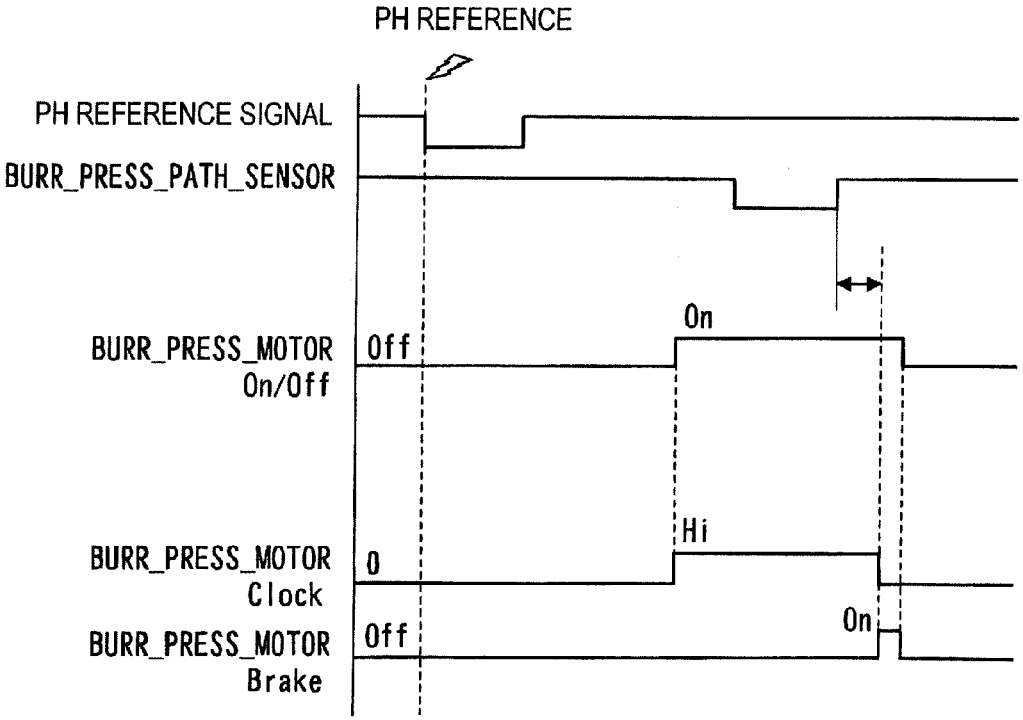
FIG. 12 is a timing chart of the driving motor operation of the burr curing device employed in the first exemplary embodiment.

Now, it is assumed that one sheet is transported from the recording material supplying device 50 (50*a*). As shown in FIG. 12, at the timing when the recording material is supplied from the recording material supplying device 50 (50*a*), a PH reference signal is created. After predetermined counting based on the PH reference signal, a driving motor clock (BURR_PRESS_MOTOR Clock) becomes Hi (High) so that the driving motor (BURR_PRESS_MOTOR) turns on. When the position detector (BURR_PRESS_PATH_SENSOR) 150 changes from Hi (absence of the recording material) into Lo (presence of the recording material), at the timing after a predetermined time elapses, a driving motor brake (BURR_PRESS_MOTOR Brake) turns on so that the driving motor (BURR_PRESS_MOTOR) turns off.

<Driving Motor Operation: Pattern of Generating Superposition)

Now it is assumed that before the driving motor (BURR_PRESS_MOTOR) turns off for a first sheet of the recording material, the on-timing of the driving motor (BURR_PRESS_MOTOR) is superposed for a second sheet of the recording material. In this case, the on-operation of the he driving motor (BURR_PRESS_MOTOR) for the second sheet of the recording material is given high priority.

According to this manner, the burr curing processing by the burr curing processing device 120 can be executed with no waste.

Figure 13:
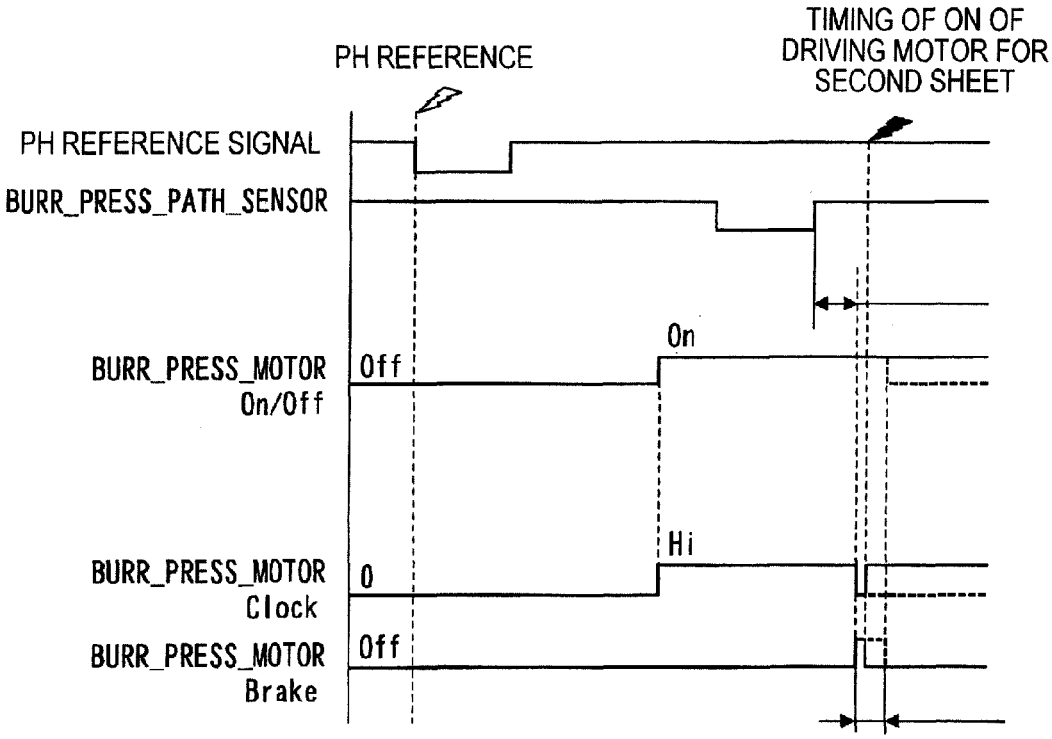
FIG. 13 is a timing chart of an example of the pattern of generating superposition in the driving motor operation of the burr curing device employed in the first exemplary embodiment.
Figure 14:
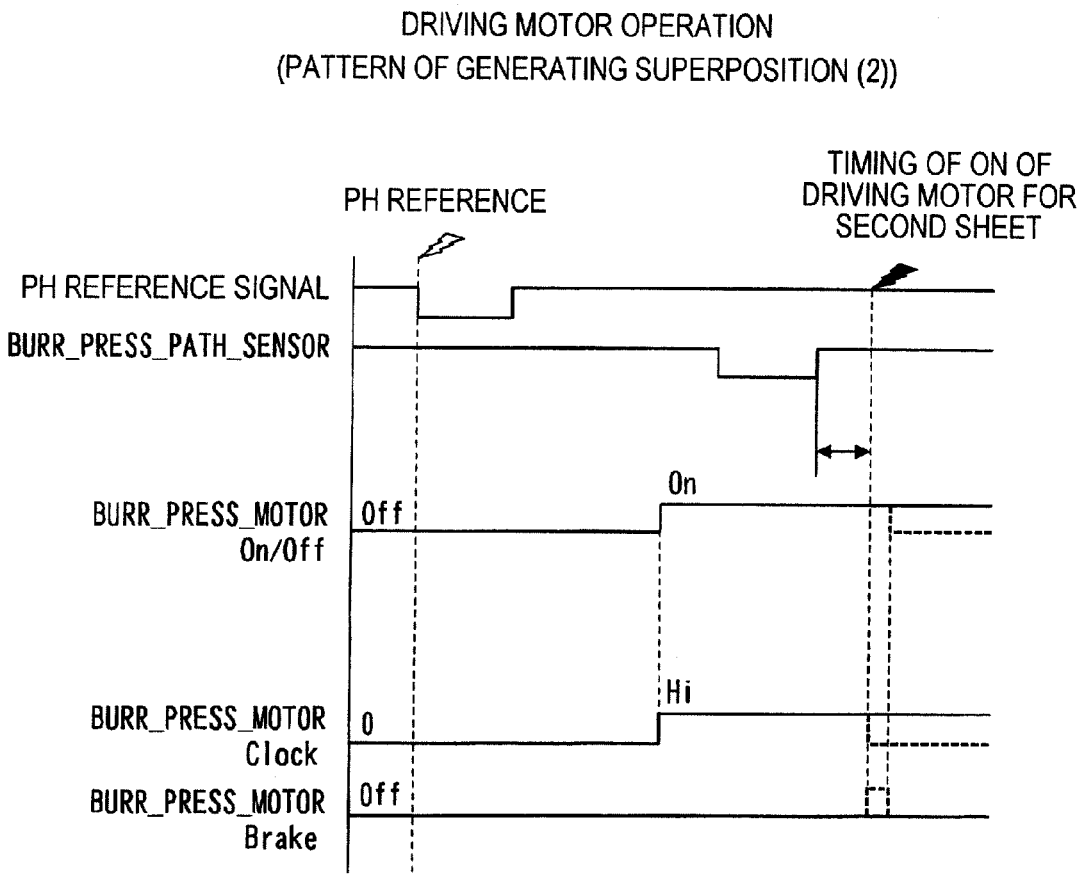
FIG. 14 is a timing chart of another example of the pattern of generating superposition in the driving motor operation of the burr curing device employed in the first exemplary embodiment.

Concrete examples of this manner are the cases where as shown in FIG. 13, with the driving motor brake (BURR_PRESS_MOTOR Brake) being kept on for the first sheet of the recording material, the on-timing of the driving motor (BURR_PRESS_MOTOR) is superposed for a second sheet of the recording material, and where as shown in FIG. 14, with the driving motor (BURR_PRESS_MOTOR) being kept on for the first sheet of the recording material, the on-timing of the driving motor (BURR_PRESS_MOTOR) is superposed for a second sheet of the recording material.

<Retract Motor Operation: Initializing Operation>

Next, an explanation will be given of the initializing operation of the retract motor 131.

In this exemplary embodiment, a retract sensor (not shown) determines whether the retract motor 131 is located at a contact position where the pressuring/transporting rolls 121, 122 are arranged in pressure-contact with each other or a retract position where they are retracted from each other.

Figure 15A:
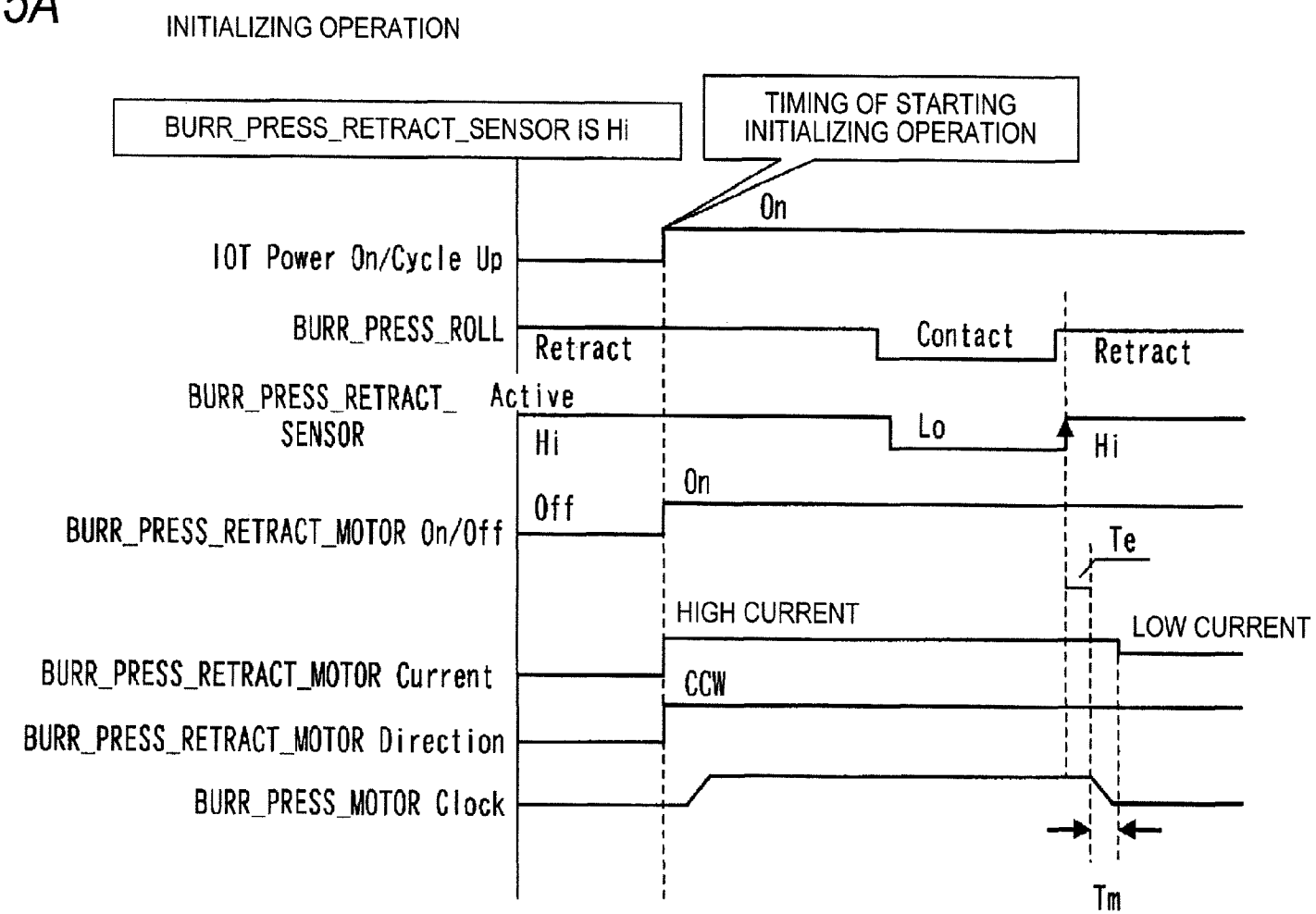
FIG. 15A is a timing chart of an example of the initializing operation of a retract motor of the burr curing device employed in the first exemplary embodiment.

Now, as shown in FIG. 15A, if the retract sensor (BURR_PRESS_RETRACT_SENSOR) is Hi, the pressurizing/transporting roll (BURR_PRESS_ROLL) is arranged in a retract state.

In this state, if the recording material processing apparatus starts the operation (at the time of IOT Power On or Cycle Up), a retract motor rotating direction signal (BURR_PRESS_RETRACT_MOTOR Direction) is outputted as a CCW (e.g. counterclockwise direction) and a retract motor current signal (BURR_PRESS_RETRACT_MOTOR Current) is outputted as a high current. Thereafter, a retract motor clock (BURR_PRESS_RETRACT_MOTOR Clock) is created. Then, the retract motor (BURR_PRESS_RETRACT_MOTOR) turns on.

If the retract motor (BURR_PRESS_RETRACT_MOTOR) continues the on-operation for a prescribed time, the pressurizing/transporting roll (BURR_PRESS_ROLL) is arranged in a contact state. Then, the retract sensor (BURR_PRESS_RETRACT SENSOR) detects Lo (Low).

Further, if the retract sensor (BURR_PRESS_RETRACT SENSOR) detects Hi from Lo, after a predetermined time Te elapses, step down (off after the retract motor clock (BURR_PRESS_RETRACT_MOTOR Clock) is reduced stepwise) is started. After a predetermined time Tm elapses, the retract motor current signal (BURR_PRESS_RETRACT_MOTOR Current) is outputted as a low current so that the pressurizing/transporting roll (BURR_PRESS_ROLL) is held in the retract state.

Particularly, in this exemplary embodiment, since the other pressurizing/transporting roll 122 does not have the driving source, in order to early make the stationary rotation of the pressurizing/transporting rolls 121, 122, the one pressurizing/transporting roll 121 is previously rotation-driven by the driving motor 141 and with the pressurizing/transporting rolls 121, 122 being kept in contact by the retract motor 131, the other pressurizing/transporting roll 122 must be rotated.

Figure 15B:
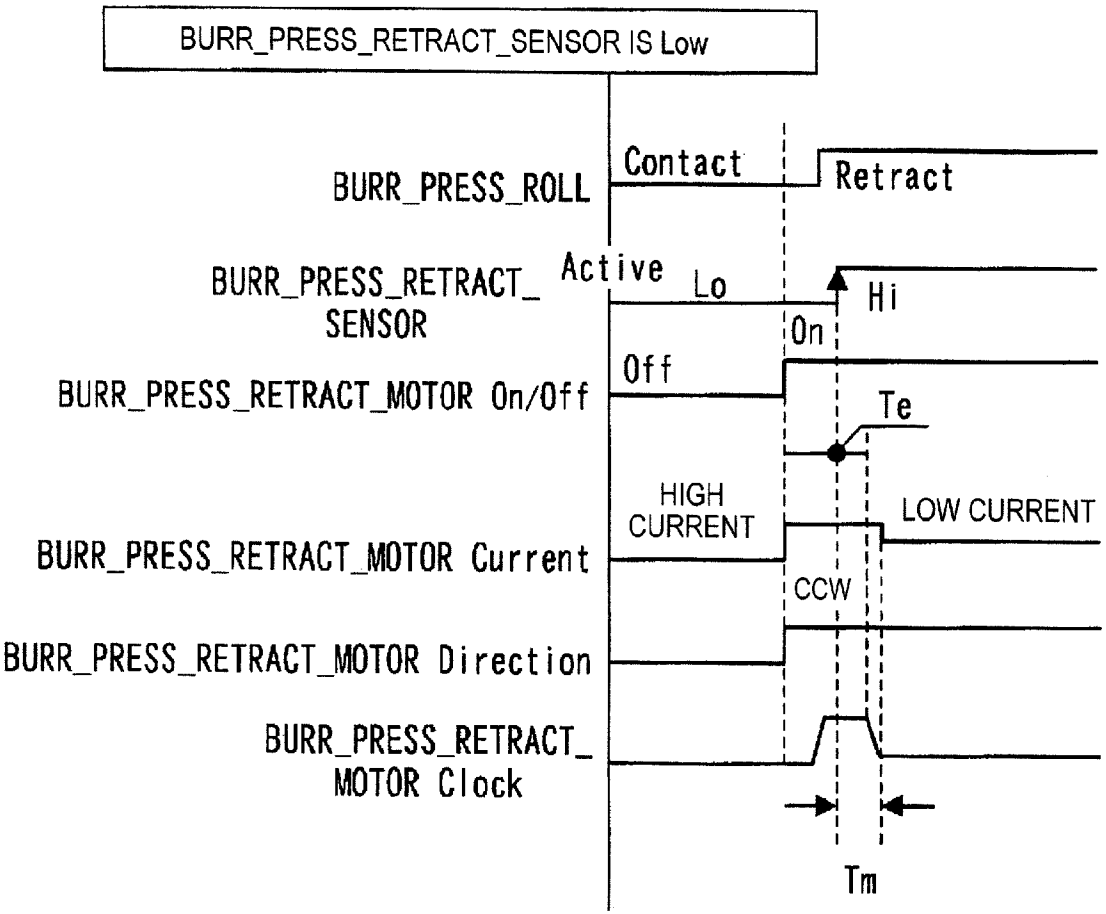
FIG. 15B is a timing chart of another example of the initializing operation of a retract motor of the burr curing device employed in the first exemplary embodiment.

Inversely, as shown in FIG. 15B, if the retract sensor (BURR_PRESS_RETRACT_SENSOR) is Lo, the pressurizing/transporting roll (BURR_PRESS_ROLL) is in the contact state.

In this state, if the recording material processing apparatus starts the operation (at the time of IOT Power On or Cycle Up), the retract motor rotating direction signal (BURR_PRESS_RETRACT_MOTOR Direction) is outputted as the CCW (e.g. counterclockwise direction) and a retract motor current signal (BURR_PRESS_RETRACT_MOTOR Current) is outputted as a high current. Thereafter, step up (the retract motor clock (BURR_PRESS_RETRACT_MOTOR Clock) is Hi) is started. Then, the retract motor (BURR_PRESS_RETRACT_MOTOR) turns on.

If the retract motor (BURR_PRESS_RETRACT_MOTOR) continues the on-operation for a prescribed time, the pressurizing/transporting roll (BURR_PRESS_ROLL) is separately arranged (retracted) from the contact state. Then, the retract sensor (BURR_PRESS_RETRACT SENSOR) detects Hi from Lo.

Thereafter, after a predetermined time Te elapses, step down (off after the retract motor clock (BURR_PRESS_RETRACT_MOTOR Clock) is reduced stepwise) is started. After a predetermined time Tm elapses, the retract motor current signal (BURR_PRESS_RETRACT_MOTOR Current) is outputted as a low current so that the pressurizing/transporting roll (BURR_PRESS_ROLL) is held in the retract state.

<Retract Motor Operation: Single-Sided Recording Operation>

Figure 16:
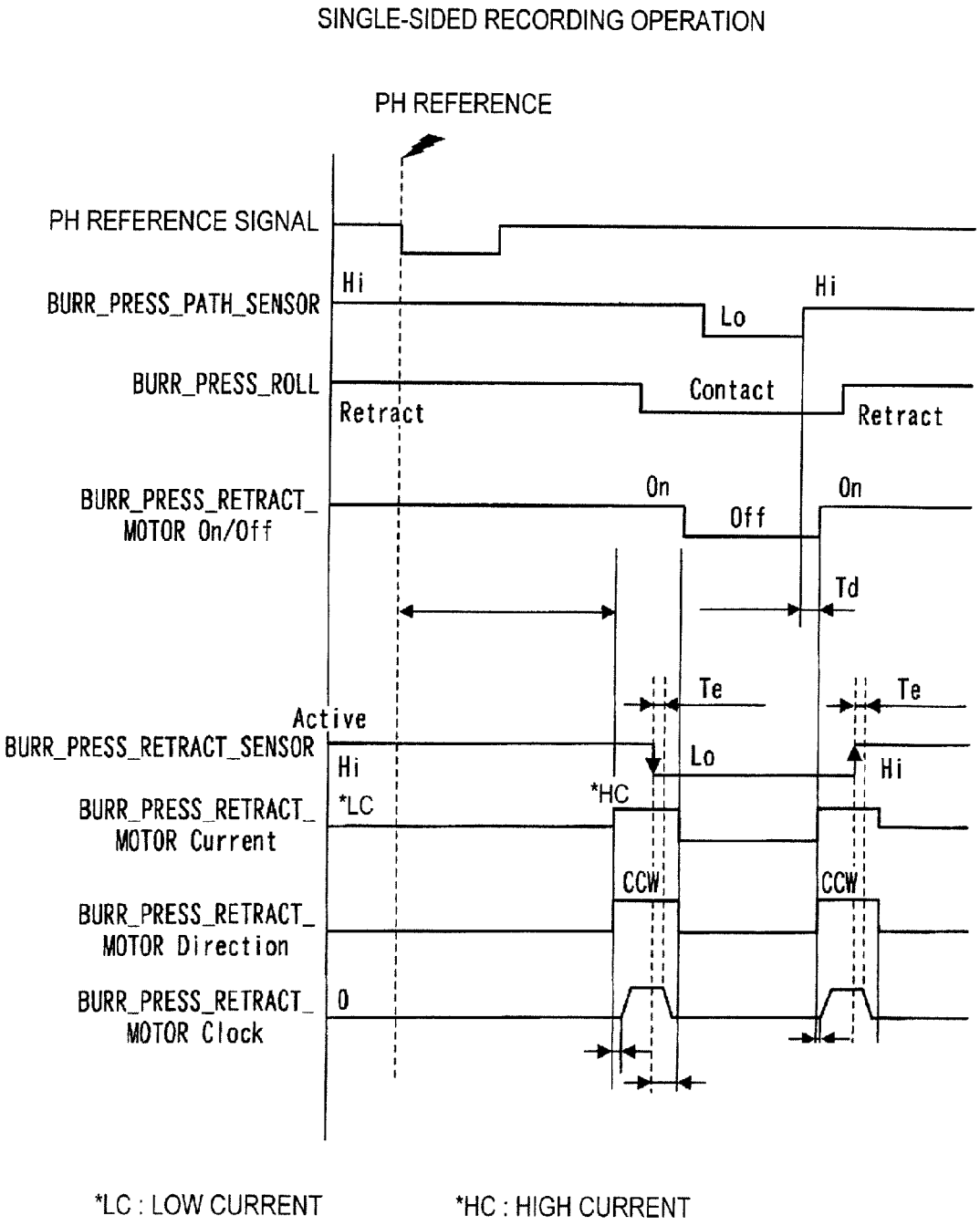
FIG. 16 is a timing chart of an example of the single-sided recording of the burr curing device employed in the first exemplary embodiment.

FIG. 16 is a timing chart of the retract motor 131 during the single-sided recording.

Now, it is assumed that the recording material having a thickness not smaller than the predetermined thickness d0 (see FIG. 11) from the recording material supplying device 50 (50*a*). In this case, as shown in FIG. 16, the PH reference signal is created at the timing when the recording material is supplied from the recording material supplying device 50 (50*a*). At this time, the retract motor (BURR_PRESS_RETRACT_MOTOR) keeps the on state.

After predetermined counting based on the PH reference signal, the retract motor rotating direction signal (BURR_PRESS_RETRACT_MOTOR Direction) is outputted as the CCW (counterclockwise direction) and the retract motor current signal (BURR_PRESS_RETRACT_MOTOR Current) is outputted as the high current. Thereafter, step up (the retract motor clock (BURR_PRESS_RETRACT_MOTOR Clock) is Hi) is started. By rotation of the retract motor (BURR_PRESS_RETRACT_MOTOR) the pressurizing/transporting roll (BURR_PRESS_ROLL) falls in the contact state from the retract state. Then, the retract sensor (BURR_PRESS_RETRACT SENSOR) detects Lo from Hi.

Thereafter, after a predetermined time Te elapses, step down (off after the retract motor clock (BURR_PRESS_RETRACT_MOTOR Clock) is reduced stepwise) is started. After a predetermined time Tm elapses, the retract motor current signal (BURR_PRESS_RETRACT_MOTOR Current) becomes off and then the retract motor (BURR_PRESS_RETRACT_MOTOR) turns off.

Further, if the position sensor (BURR_PRESS_PATH_SENSOR) 150 detects Hi from Lo, after a predetermined time Td elapses, the retract motor rotating direction signal (BURR_PRESS_RETRACT_MOTOR Direction) is outputted as the CCW (counterclockwise direction) and the retract motor current signal (BURR_PRESS_RETRACT_MOTOR Current) is outputted as the high current. Thereafter, the retract motor (BURR_PRESS_RETRACT_MOTOR) turns on so that step up (the retract motor clock (BURR_PRESS_RETRACT_MOTOR Clock) is Hi) is started. By rotation of the retract motor (BURR_PRESS_RETRACT_MOTOR), the pressurizing/transporting roll (BURR_PRESS_ROLL) falls in the retract state from the contact state. Then, the retract sensor (BURR_PRESS_RETRACT SENSOR) detects Hi from Lo.

Thereafter, after a predetermined time Te elapses, step down (off after the retract motor clock (BURR_PRESS_RETRACT_MOTOR Clock) is reduced stepwise) is started. After a predetermined time Tm elapses, the retract motor current signal (BURR_PRESS_RETRACT_MOTOR Current) is outputted as the low current so that the pressurizing/transporting roll (BURR_PRESS_ROLL) is held in the retract state.

<Retract Motor Operation: Double-Sided Recording Operation>

Now, it is assumed that the imaging mode is the double-sided recording mode and the recording material whose imaging plane is the second plane (recording material (Dup.) has returned to the pre-imaging transporting path 61 via the return-transporting path 64 and the inverting-transporting path 65.

Figure 17:
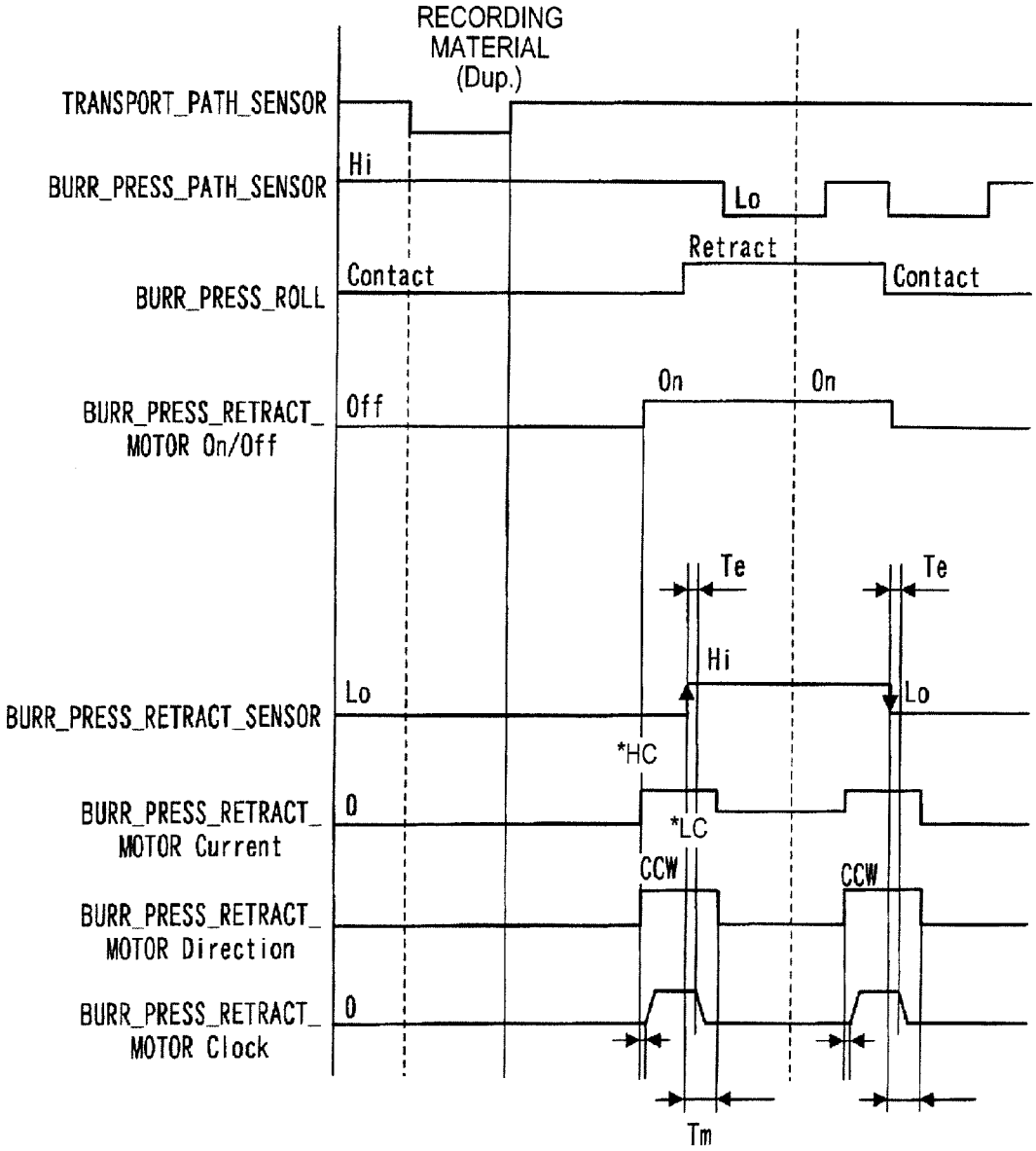
FIG. 17 is a timing chart of an example of the double-sided recording of the burr curing device employed in the first exemplary embodiment.

In this state, as shown in FIG. 17, if the recording material (Dup.) passes the double-sided recording position detector (TRANSPORT_PATH_SENSOR) 153 (see FIGS. 4 and 5), after predetermined counting from when the double-sided recording position detector (TRANSPORT_PATH_SENSOR) turns on, the retract motor rotating direction signal (BURR_PRESS_RETRACT_MOTOR Direction) is outputted as the CCW (counterclockwise direction) and the retract motor current signal (BURR_PRESS_RETRACT_MOTOR Current) is outputted as the high current so that the retract motor (BURR_PRESS_RETRACT_MOTOR) turns on. Thereafter, step up (the retract motor clock (BURR_PRESS_RETRACT_MOTOR Clock) is Hi) is started. By rotation of the retract motor (BURR_PRESS_RETRACT_MOTOR), the pressurizing/transporting roll (BURR_PRESS_ROLL) falls in the retract state from the contact state. Then, the retract sensor (BURR_PRESS_RETRACT SENSOR) detects Hi from Lo.

Thereafter, after a predetermined time Te elapses, step down (off after the retract motor clock (BURR_PRESS_RETRACT_MOTOR Clock) is reduced stepwise) is started. After a predetermined time Tm elapses, the retract motor current signal (BURR_PRESS_RETRACT_MOTOR Current) is outputted as the low current so that the pressurizing/transporting roll (BURR_PRESS_ROLL) is held in the retract state.

Therefore, when the recording material (Dup.) passes the burr curing device 120, the burr curing processing by the burr curing device 120 will not be executed.

In this exemplary embodiment, as shown in FIGS. 4 and 5, a point of the pre-imaging transporting path 61 where the double-sided recording position detector 153 is arranged is the point where the recording material supplied from the recording material supplying device 50 (concretely, 50*b*) also passes. However, where the recording material is supplied from the recording material supplying device 50 (50*b*), the PH reference signal is created at the supplying timing. On the other hand, in the case of the recording material (recording material (Dup.) whose imaging plane during the double-sided recording mode is the second plane, the PH reference signal is not created. So, the control device 160 can discriminate both cases from each other.

Exemplary Embodiment 2

Figure 18:
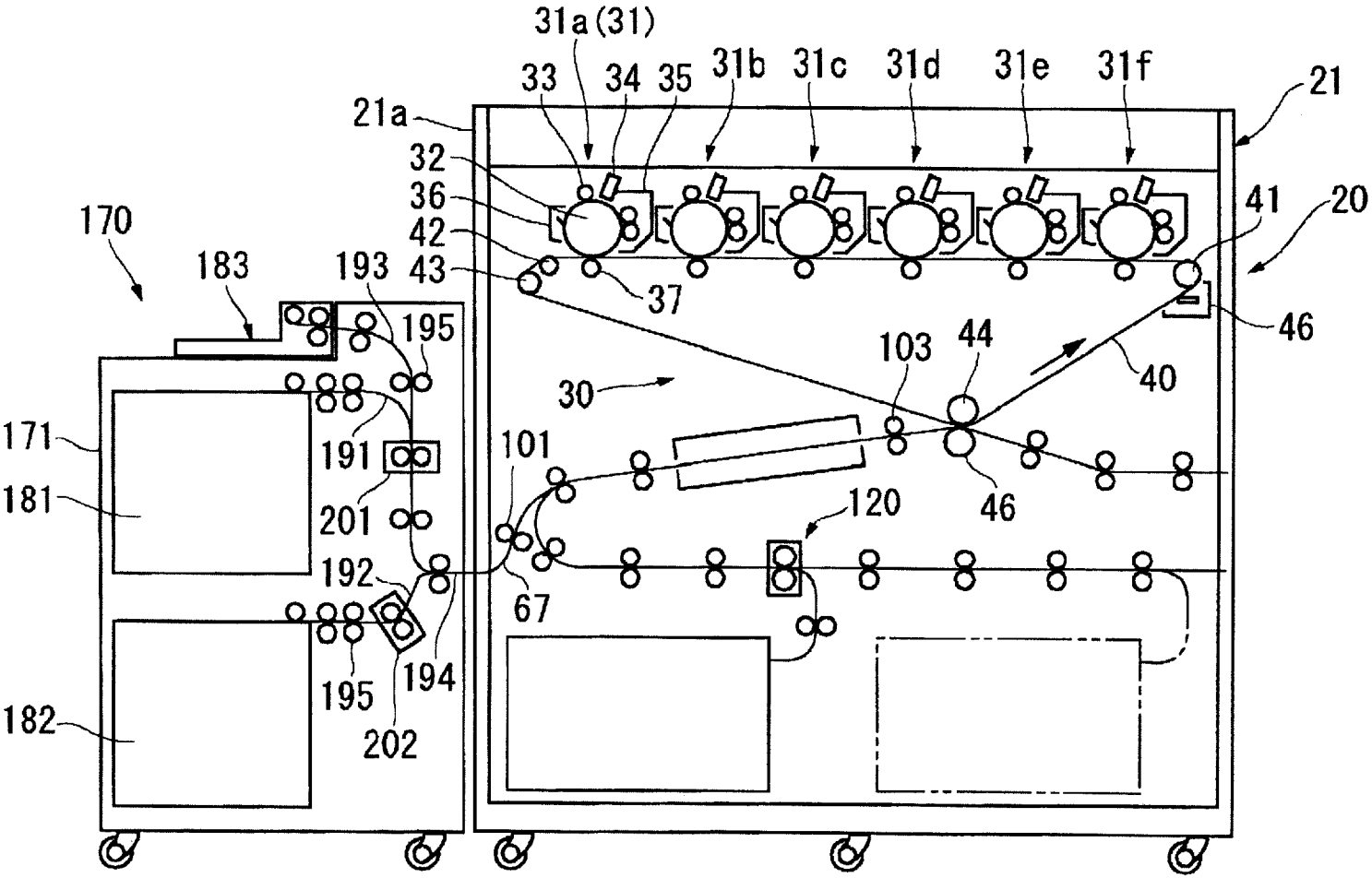
FIG. 18 is a view for explaining the entire configuration of the second exemplary embodiment of a recording material processing apparatus according to this invention.

FIG. 18 shows the entire configuration of the second exemplary embodiment of the recording material processing apparatus according to this invention.

In FIG. 18, the recording material processing apparatus includes an image forming device 20 according to the first exemplary embodiment (imaging unit 21+fixing unit (the fixing unit 22 is not shown) and an out-board recording material carry-in device 170 which supplies recording materials to the image forming device 20. Since the structure of the image forming device 20 is substantially the same as that in the first exemplary embodiment, like reference symbols referring to like constituent elements in the first exemplary embodiment will not be explained in detail.

Figure 19:
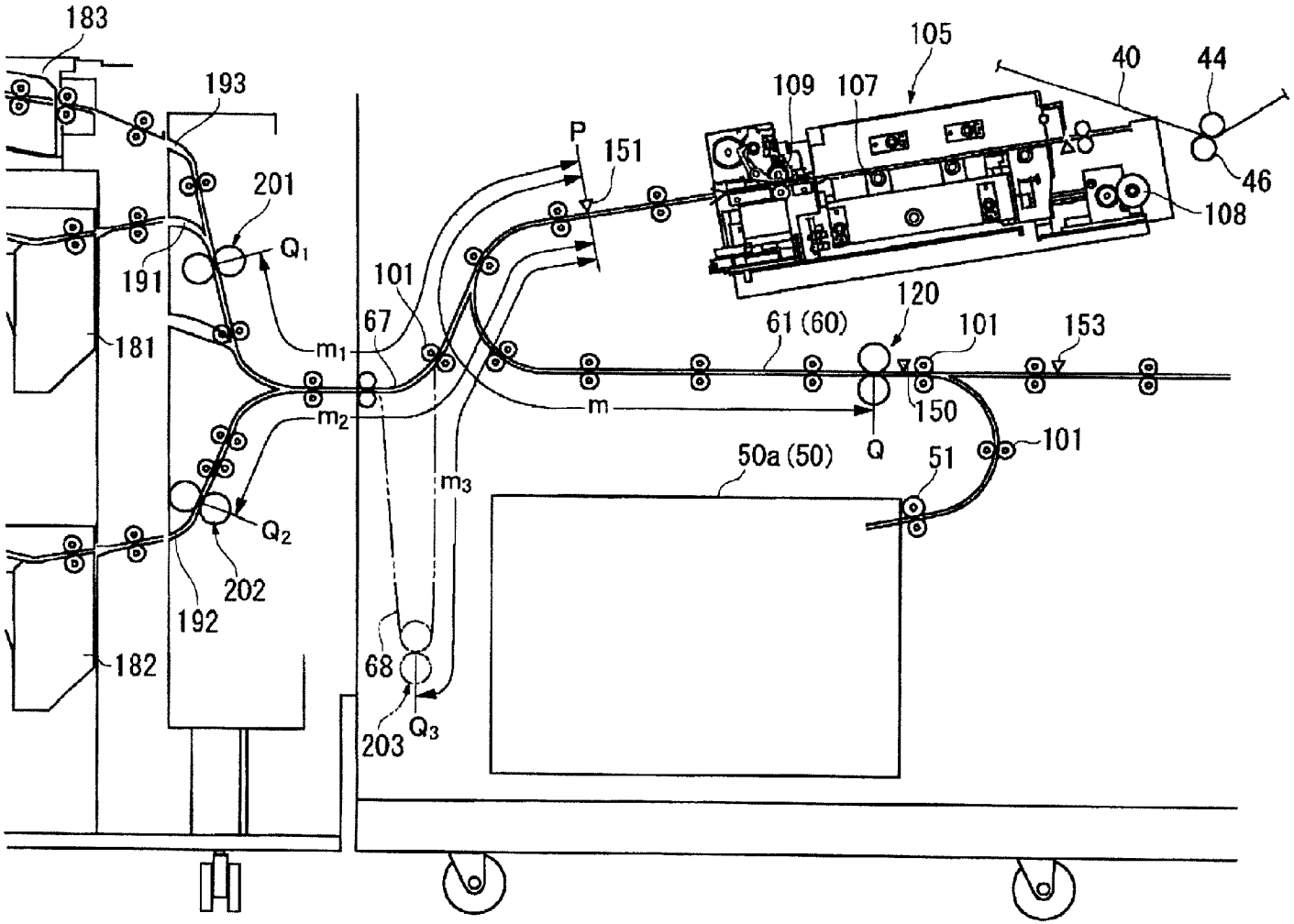
FIG. 19 is a view for explaining the main part of FIG. 18.

In this exemplary embodiment, the recording material carry-in device 170, as shown in FIGS. 18 and 19, includes a carry-in device box 171 within which two upper and lower large-capacity recording material supplying devices 181, 182 are arranged and at whose apex, a manual-feeding recording material supplying device 183 is arranged.

Transporting paths 191 to 193 are extended from the large-capacity recording material supplying devices 181, 182 and manual-feeding recording material supplying device 183, respectively. These transporting paths 191 to 193 are eventually merged into a single merged transporting path 194 which leads to a discharging mouth of the carry-in device box 171. An appropriate number of transporting rolls 195 serving as transporting members are arranged on each of the transporting paths 191 to 194.

On the other hand, an imaging unit box 21*a* of the imaging unit 21 of the image forming device 20 includes a carry-in transporting path 67 which receives the recording material supplied from the recording material carry-in device 170. The carry-in transporting path 67 is merged with the midpoint of the pre-imaging transporting path 61 to transport the recording material toward the secondary transfer point of the imaging device 30. An appropriate number of transporting rolls 101 serving as transporting members are also arranged on the carry-in transporting path 67.

In this exemplary embodiment, a burr curing device 201 or 202 is arranged on the transporting path 191 or 192.

The burr curing device 201 or 202 is constructed in the same manner as the burr curing device 120 within the image forming device 20.

The length m1 of the transporting path between the arranging position Q1 of the burr curing device 201 and the transportation changing position P of the pre-imaging transporting path 61 (arranging position of the transportation changing position detector 151) is set to be longer than the length in the transporting direction of the recording material.

Where the burr curing device 202 is arranged, The length m2 of the transporting path between the arranging position Q2 of the burr curing device 202 and the transportation changing position P of the pre-imaging transporting path 61 (arranging position of the transportation changing position detector 151) is set to be longer than the length in the transporting direction of the recording material.

Therefore, in this exemplary embodiment, the recording material supplied from e.g. the large-capacity recording material supplying device 181 or manual-feeding recording material supplying device 183, when it passes the transporting path 191, is subjected to burr curing processing by the burr curing device 201 under the condition requiring burr curing processing and thereafter is carried in the image forming device 20 side.

Further, the recording material supplied from e.g. the large-capacity recording material supplying device 182, when it passes the transporting path 192, is subjected to burr curing processing by the burr curing device 202 under the condition requiring burr curing processing and thereafter is carried in the image forming device 20 side.

Accordingly, in either manner, there is no fear that the burrs of the recording material damages the intermediate transfer belt 40, secondary transfer member (secondary transfer roll) 45 or the fixing belt 71 serving as the fixing member of the fixing device 70 (see FIG. 3).

Further, in this exemplary embodiment, when the recording material carried in from the recording material carry-in device 170 reaches the transportation changing position P, its transporting speed is changed e.g. from the high speed (v0) to the low speed (v1). However, even where the recording material having a maximum using size is used, after the recording material has passed through the burr curing device 201 or 202, the transporting speed of the recording material changes. For this reason, likewise for the burr curing device 120, for the burr curing device 201 or 202 also, the system of keeping the transporting speed of the recording material can be adopted.

In this exemplary embodiment, the burr curing device 201 or 202 was provided on the side of the recording material carry-in device 170. Without being limited to such a manner, for example, as indicated by two-dot chain line in FIG. 19, a carry-in transporting path 68 having a relatively longer path length may be provided separately within the imaging unit 21 of the image forming device 20 and a burr curing device 203 may be arranged on this carry-in transporting path 68.

In this case, the length m3 of the transporting path between the arranging position Q3 of the burr curing device 202 and the transportation changing position P of the pre-imaging transporting path 61 (arranging position of the transportation changing position detector 151) may be set to be longer than the length in the transporting direction of the recording material.

Exemplary Embodiment 3

Figure 20:
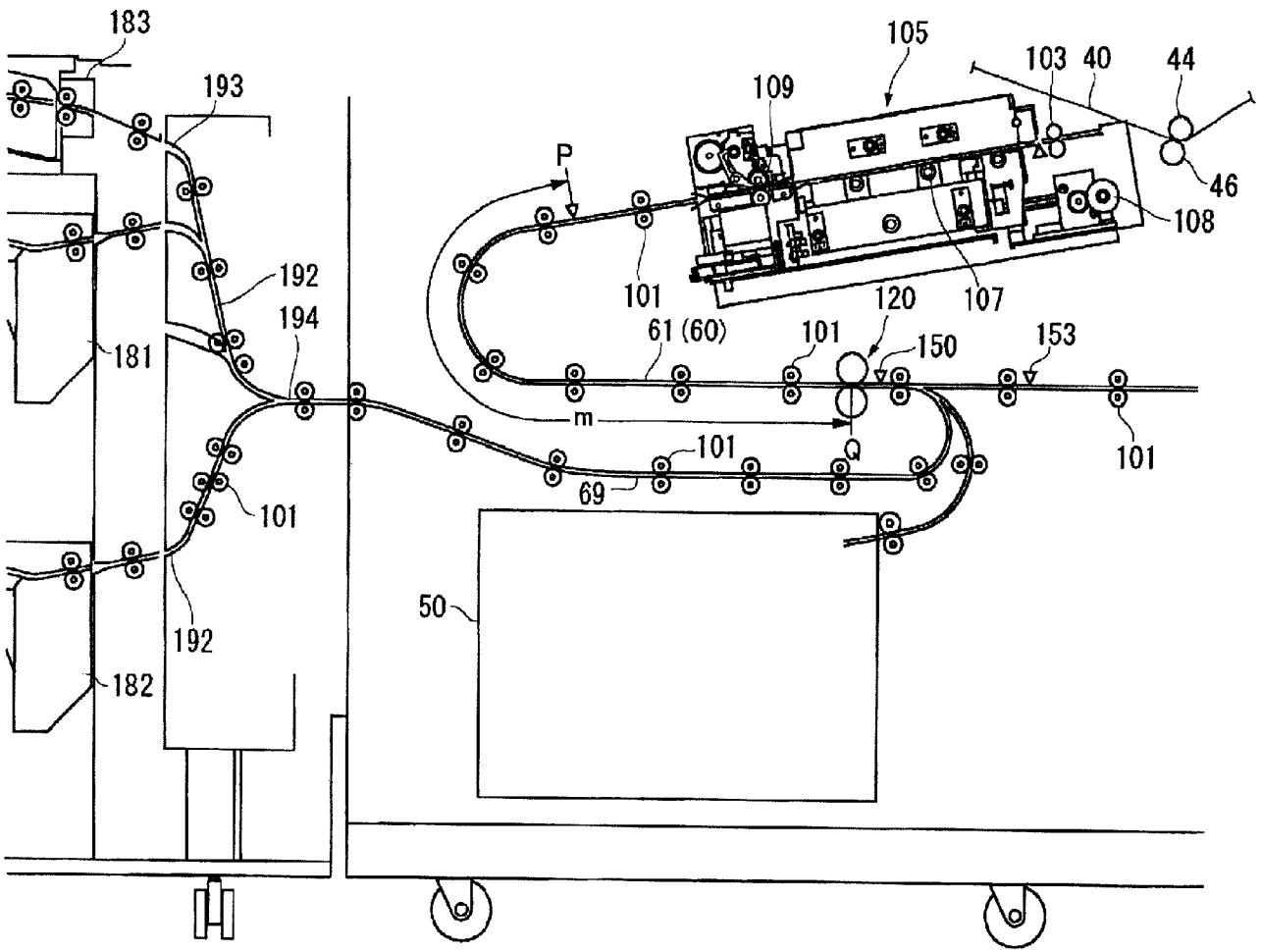
FIG. 20 shows the main part of the third exemplary embodiment of the recording material processing apparatus according to this invention.

FIG. 20 shows the main part of the third exemplary embodiment of the recording material processing apparatus according to this invention.

In this exemplary embodiment, the basic configuration of the recording material processing apparatus is substantially the same as the second exemplary embodiment in that it includes the image forming device 20 and the recording material carry-in device 170 and is different therefrom in that it does not separately provided with any burr curing device except the burr curing device 120. In this exemplary embodiment, like reference symbols referring to like constituent elements in the second exemplary embodiment will not be explained in detail.

In this exemplary embodiment, the imaging unit 21 of the image forming device 20 is provided with a carry-in transporting path 69 into which the recording material can be carried from the recording material carry-in device 170. This carry-in transporting path 69 server to connect the point on the upstream side in the recording material transporting direction of the burr curing device 120 in the pre-imaging transporting path 61 and the carry-in mouth of the recording material from the recording material carry-in device 170. An appropriate number of transporting rolls 101 serving as transporting members are also arranged on the carry-in transporting path 69.

In this exemplary embodiment, the recording material carried in the image forming device 20 from the recording material carry-in device 170 is transported to the pre-imaging transporting path 61 via the carry-in transporting path 69, and after passing the burr curing device 120, transported to the secondary transfer point of the imaging device 30 via the transportation changing position P.

Under the condition that the recording material carried in from the recording material carry-in device 170 must be subjected to the burr curing, the pertinent recording material, after having been subjected to the burr curing processing by the burr curing device 120, is transported to the imaging device 30 and reaches the fixing device 70. For this reason, there is no fear that the burrs of the recording material carried in from the recording material carry-in device 170 damages the intermediate transfer belt 40, secondary transfer member (secondary transfer roll) 45 or the fixing device 70.

Particularly, in this exemplary embodiment, since the burr curing device 120 provided in the image forming device 20 is commonly used, this exemplary embodiment is more desirable than the second exemplary embodiment in that there is no need of separately providing the burr curing device.

EXAMPLES

Example 1

The burr curing device employed in the recording material processing apparatus according to the first exemplary embodiment was taken as a first example. The degree of damage of the fixing belt 71 according to the presence or absence of the burr curing was examined.

Figure 21A:
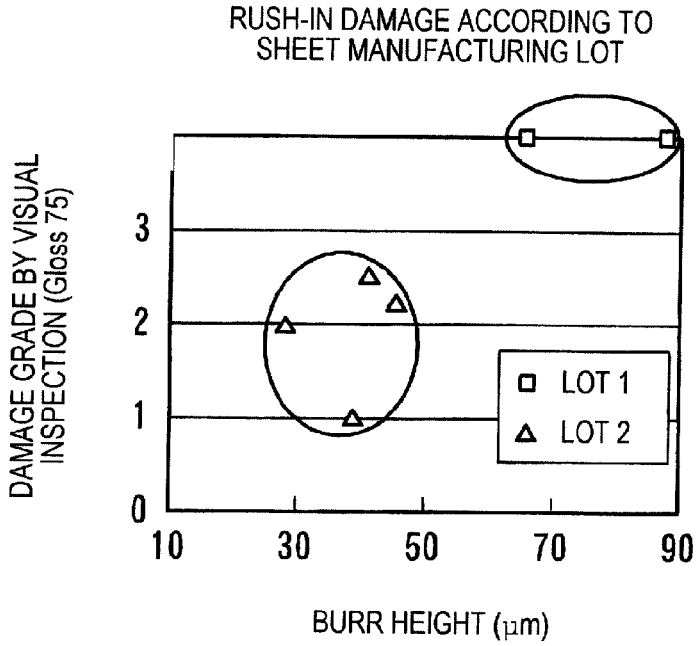
FIG. 21A is a graph showing the relationship between a burr height of a sheet being the recoding material and the grade of a damage by visual inspection of a fixing belt in the recording material processing apparatus according to the example 1.

Now, as shown in FIG. 21A, as a result of examining the burrs to be cut of the sheets for various manufacturing lots of sheets being the recording materials, it can be understood that there are different burr height distributions for the respective manufacturing lots of sheets.

So, the damage of the fixing belt 71 was examined for the cases where the sheets having a high burr height were subjected to the burr curing processing (pressurizing load/e.g. 50 kgf: 498N) by using the burr curing device 120 and where they were not done. The examination result is shown in FIG. 21B.

Figure 21B:
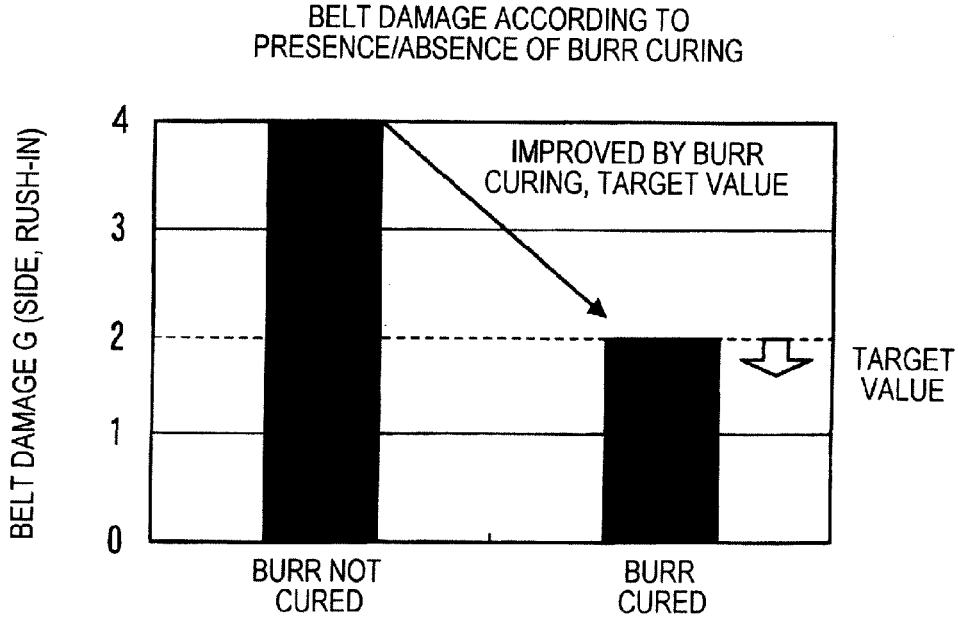
FIG. 21B is a graph showing the relationship between the presence/absence of the burr curing processing by the burr curing device and the grade of a damage by visual inspection of a fixing belt.

It can be seen from FIG. 21B that the first example subjected to the burr curing processing gives less damage of the fixing belt 71 than a comparative example not subjected to the burr curing processing.

Example 2

The burr curing device employed in the recording material processing apparatus according to the first exemplary embodiment was taken as a second example. The performance of the burr curing was evaluated.

Figure 22A:
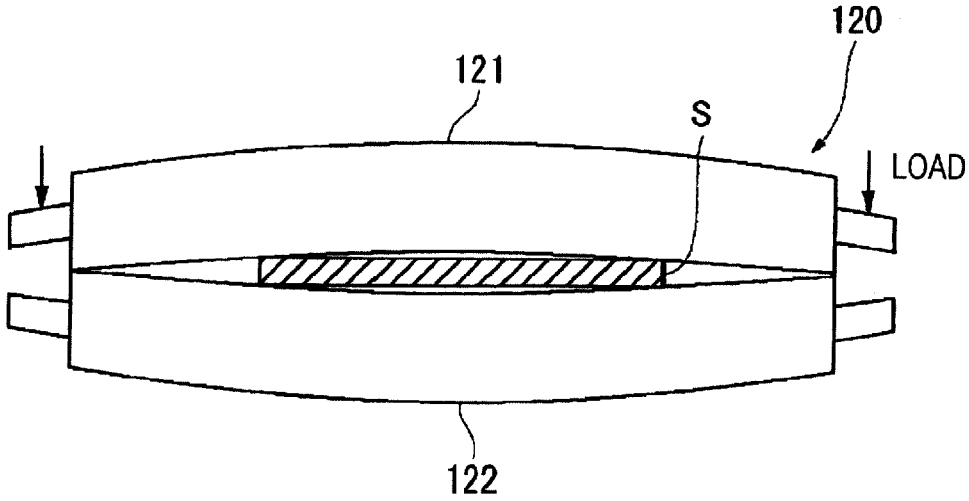
FIG. 22A is a schematic view for explaining the state of the sheet when it passes the burr curing device in the recording material processing apparatus according to the example 2.

Now, as shown in FIG. 22A, where the sheet S being the recording material is pressurizing-transported by the pair of pressurizing/transporting rolls 121, 122 at a predetermined load (e.g. 50 kgf: 498N), a heavy load is applied on the sheet edge, e.g. the edge at the leading end in the transporting direction of the sheet and edge in the width direction perpendicular to the transporting direction, thereby permitting the burrs of the sheet S to be reduced.

Figure 22B:
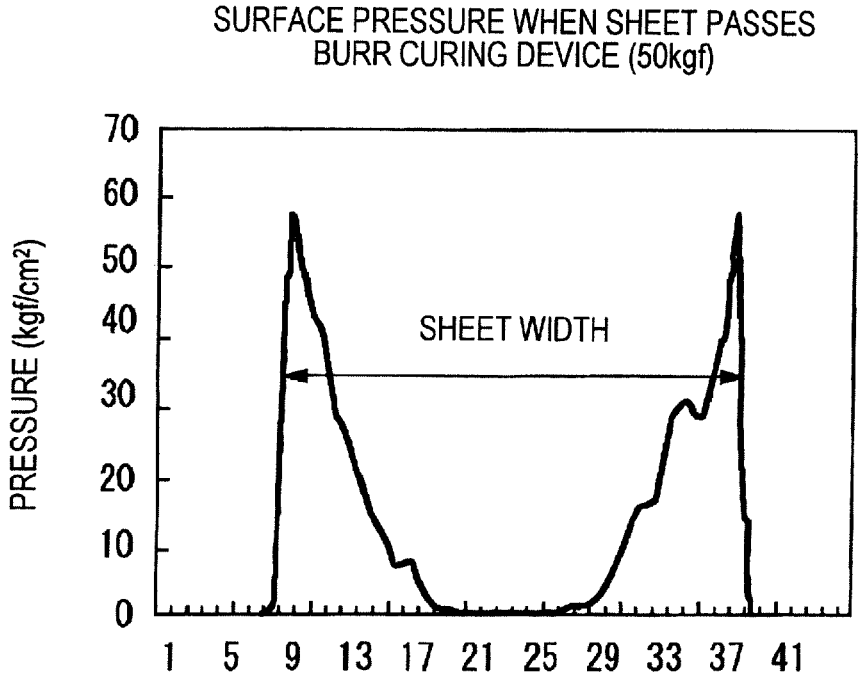
FIG. 22B is a graph showing the surface pressure at respective positions when the sheet passes the burr curing device.

FIG. 22B shows the measurement result of the distribution of load applied to the region in the width direction of the sheet. It can be seen that the heaviest load is applied to both side edges of the sheet.

INDUSTRIAL APPLICABILITY

In this exemplary embodiment, since the burr curing device 120, 201 to 203 is provided at the point where the transporting speed of the recording material does not change, the recording material is transported stably at a constant speed.

In view of this fact, where an annotation device (write-once means) or inline sensor (sensor for reading the image recorded) is set up, they may be set up at the same point as the point where the burr curing device 120, 201 to 203 is set up.

For example, where the annotation device is set up, an annotation (e.g. logo mark) on the user's side can be added to a predetermined point of the recording material.

Further, where the inline sensor is set up, the image density of the recording material and image position on the front and back of the recording material can be precisely detected.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording material processing apparatus comprising:

a recording material supplying device that supplies a recording material;

an image recording device that records an image on the recording material at a predetermined recording position of the image recording device;

a recording material transporting mechanism that includes:

a recording material transporting path that is between the recording material supplying device and the predetermined recording position of the image recording device, and that transports the recording material to the recording position of the image recording device;

a transporting member that is arranged along the recording material transporting path;

a burr curing device that includes:

a pair of pressurizing members that pressurize the recording material to cure the burrs at the edge of the recording material, wherein the pair of the pressurizing members is provided on the recording material transporting path between the recording material supplying device and a transportation changing position;

a burr curing control device configured to determine necessity/unnecessity of burr curing at an edge of the recording material and bring the pair of the pressurizing members into contact with or retracted from each other based on a result of determination, wherein the burr curing control device includes a recording material kind determining unit configured to determine a thickness of the recording material, the burr curing control device as a result of the recording material kind determining unit determining that the recording material has a thickness equal to or larger than a predetermined thickness, brings the pair of the pressurizing members into contact with each other to cure the burrs at an edge of the recording material, and the burr curing control device as a result of the recording material kind determining unit determining that the recording material has a thickness smaller than the predetermined thickness, retracts the pair of the pressurizing members from each other so as not to cure the burrs at the edge of the recording material.

2. A recording material processing apparatus comprising:

a recording material supplying device that supplies a recording material;

an image recording device that records an image on the recording material at a predetermined recording position of the image recording device;

a recording material transporting mechanism that includes:

a recording material transporting path that is between the recording material supplying device and the predetermined recording position of the image recording device, and that transports the recording material to the recording position of the image recording device;

a transporting member that is arranged along the recording material transporting path;

a burr curing device that includes:

a pair of pressurizing members that pressurize the recording material to cure the burrs at the edge of the recording material, wherein the pair of the pressurizing members is provided on the recording material transporting path between the recording material supplying device and a transportation changing position;

a burr curing control device configured to determine necessity/unnecessity of burr curing at the edge of the recording material and brings the pair of the pressurizing member into contact with or retracted from each other based on the result of determination; and a recording material returning path along which the recording material with one-side surface already recorded via the image recording device, after having being inverted, is returned toward an upstream side of the burr curing device so that the other-side surface of the recording material being is to be recorded via the image recording device in addition to the imaging on the one-side surface, wherein the burr curing control device has a recording material imaging determining unit configured to determine whether an imaging is performed on the one-side surface of the recording material or on the other-side surface of the recording material, the burr curing control device as a result of the recording material imaging determining unit determining that the imaging is to be performed on the one-side surface of the recording material, brings the pair of the pressurizing members into contact with each other to cure the burrs at an edge of the recording material, and the burr curing control device as a result of the recording material imaging determining unit determining that the imaging is to be performed on the other-side surface of the recording material with the imaging on the one-side surface already performed, retracts the pair of the pressurizing members from each other so as not to cure the burrs at the edge of the recording material a second time.

* * * * *